US006134403A

United States Patent [19]

Haneda et al.

[11] Patent Number: 6,134,403

[45] Date of Patent: Oct. 17, 2000

[54] COLOR IMAGE FORMING APPARATUS HAVING DEVELOPING DEVICES LOCATED WITHIN A CENTRAL ANGLE OF 180°

[75] Inventors: Satoshi Haneda; Hisayoshi Nagase, both of Hachioji; Toshihide Miura, Koganei; Hiroyuki Tokimatsu, Hachioji, all of Japan

[73] Assignee: Konica Corporation, Tokyo, Japan

[21] Appl. No.: 08/949,011

[22] Filed: Oct. 10, 1997

[30] Foreign Application Priority Data

| | | | |
|---|---|---|---|
| Oct. 14, 1996 | [JP] | Japan | 8-270546 |
| Oct. 14, 1996 | [JP] | Japan | 8-270547 |
| Dec. 10, 1996 | [JP] | Japan | 8-329505 |
| Dec. 24, 1996 | [JP] | Japan | 8-343224 |

[51] Int. Cl.[7] ..... G03G 15/00; G03G 15/01

[52] U.S. Cl. ..... 399/107; 399/223; 399/284

[58] Field of Search ..... 399/107, 223, 399/110–112, 298, 303, 316, 388, 397, 274, 284

[56] References Cited

U.S. PATENT DOCUMENTS

| | | | |
|---|---|---|---|
| 5,541,722 | 7/1996 | Ikeda et al. | 399/223 X |
| 5,663,787 | 9/1997 | Haneda et al. | 399/112 |
| 5,729,809 | 3/1998 | Haneda et al. | 399/308 |
| 5,752,133 | 5/1998 | Nagase et al. | 399/112 |

*Primary Examiner*—William J. Royer

*Attorney, Agent, or Firm*—Frishauf, Holtz, Goodman, Langer & Chick, P.C.

[57] ABSTRACT

A color image forming apparatus includes a photoreceptor drum having an outer diameter of 50 mm to 100 mm and a rotational axis, four charging devices for charging the photoreceptor drum, and four exposure devices, provided inside the photoreceptor drum, for imagewise exposing an inner surface of the photoreceptor drum to form respective four latent images. Four developing devices are provided outside the photoreceptor drum at an upper section thereof for developing respective ones of the four latent images using respective different one-component type color developers to form four different color toner images in a superimposed manner on an outer surface of the photoreceptor drum during one rotation thereof the photoreceptor drum. Each developing device has a developing roller for conveying the respective one-component type developers to the outer surface of the photoreceptor drum, and the four developing devices are arranged along an outer circumference of the photoreceptor drum in a manner such that a rotational axis of each of the developing rollers is located within a central angle of 180°. In addition, a transfer device is provided at a lower section of the photoreceptor drum for transferring the superimposed four different color toner images from the outer surface of the photoreceptor drum to a sheet. The transfer device includes an inlet sheet passage and an outlet sheet passage, and the outlet sheet passage is arranged either coplanar with the inlet sheet passage or inclined with respect to the inlet sheet passage at an angle between 10° above the inlet sheet passage and 30° beneath the inlet sheet passage.

13 Claims, 18 Drawing Sheets

FIG. 3 ( a )
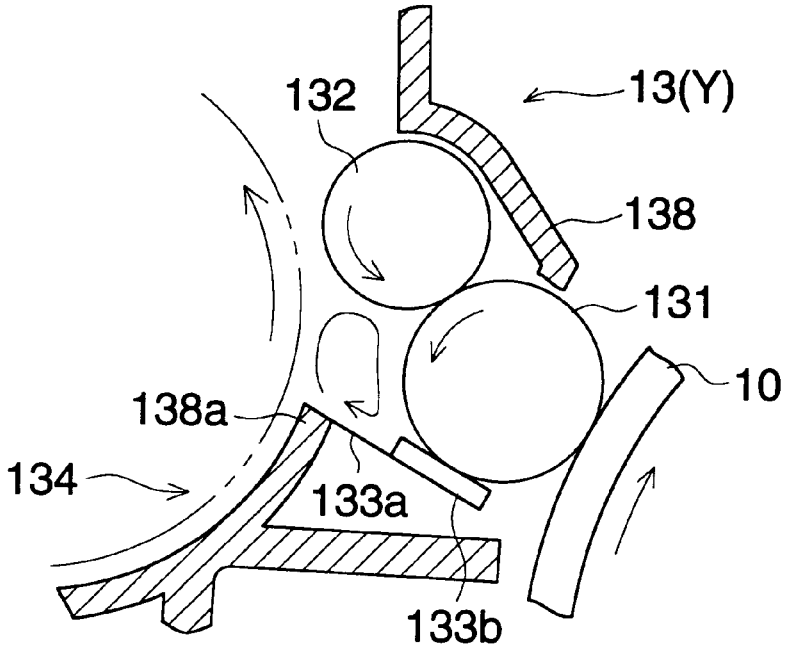
FIG. 3 ( b )
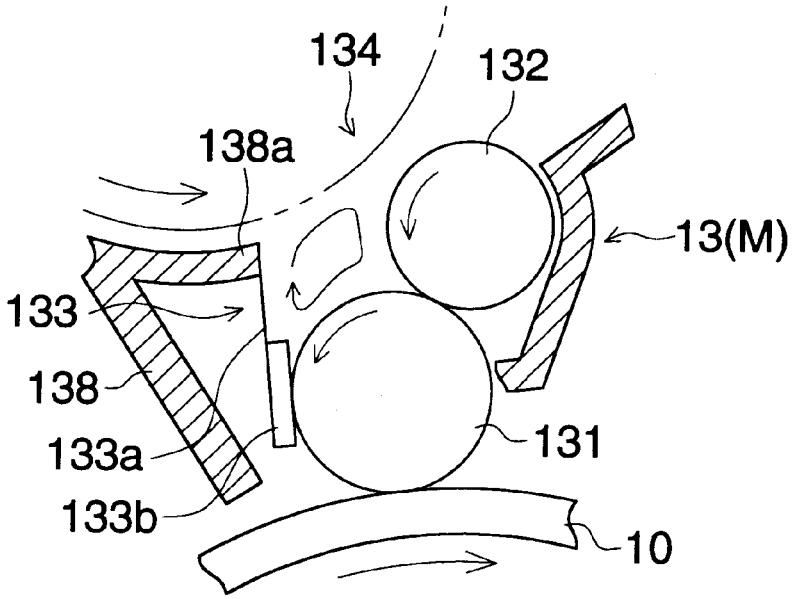

COLOR IMAGE FORMING APPARATUS HAVING DEVELOPING DEVICES LOCATED WITHIN A CENTRAL ANGLE OF 180°

BACKGROUND OF THE INVENTION

In an electrophotographic copying machine, the present invention relates to an image forming apparatus having a developing device which develops an electrostatic latent image using one-component developer composed mainly of non-magnetic toner particles.

Heretofore, developing devices employed one-component developer composed of non-magnetic toner, as one of the developing devices used for an electrophotographic copying device. The developing device employs a rotating cylindrical developing roller the surface of which is relatively coarse. On the surface of this developing roller, one-component developer (toner) is applied. The one-component developer is conveyed to the developing region in the identical direction as the rotation of the image forming body. The developer is also used in non-contact development in which toner is developed non-contactly with the surface of the image forming body. Japanese Patent Publication Open to Public Inspection (hereinafter, Japanese Patent O.P.I. Publication) 7-160109 discloses such a developing method.

In the case of a developing device employing two-component developer, toner and carrier are stirred and mixed. By means of triboelectric charging, a charge is provided to the toner. However, if the stirring means is provided in the container of the developing device, the developing device employing the two-component developer necessarily becomes larger compared with a developing device employing one-component developer.

For an image forming apparatus forming a multi-color image, there is an image forming apparatus in which chargers, image exposure means and plural developing devices respectively housing toner of each color are provided around an image forming body, for example a photoreceptor drum and charging, image exposure and developing are repeated over several rotations of the photoreceptor drum so that multiple toner images are superposed on the photoreceptor drum and the toner images are transferred onto a recording medium for fixing. Since the image forming apparatus requires considerable time for image formation, an image forming apparatus in which plural sets of chargers, image exposure means and developing devices are provided in the vicinity of the photoreceptor drum, a toner image is superposed within one rotation of the photoreceptor drum and a full color image is formed, which is excellent in terms of shortening processing time. However, the apparatus also has shortcomings: since plural sets of chargers, image exposure means and developing devices are provided in the vicinity of the photoreceptor drum, the photoreceptor drum is necessary to be large, causing the overall apparatus also to be a larger size. In addition, defective separation of a recording medium from the photoreceptor drum easily occurs.

SUMMARY OF THE INVENTION

The present invention improves on the conventional apparatus in a more rationalized layout. A first object of the present invention is to provide a compact and highly-reliable color image forming apparatus, realized by a well-balanced machine, featuring high positional accuracy and assured feeding of the recording medium.

The above-mentioned first object can be attained by the following constitution. Namely, a color image forming apparatus wherein, after charging, image exposure and developing are repeated on an image forming body and then a toner image is superposed on the image forming body, the toner image is simultaneously transferred onto a recording medium, wherein the apparatus has respectively 4 sets of image exposure means and developing means, the image exposure means comprises a unit inside the image forming body, the image forming body being a drum-shaped image forming body in which the outer diameter is 50–100 mm and the developing means are located around the periphery of the image forming body within a central angle of 180°.

A color image forming apparatus wherein, after a toner image is superposed on the image forming body after repeating charging, exposure and developing onto the image forming body, the toner image is simultaneously transferred onto a recording medium, wherein after charging, image exposure and developing are repeated on an image forming body and a toner image is superposed on the image forming body, the toner image is simultaneously transferred onto a recording medium, wherein the apparatus has respectively 4 sets of image exposure means and developing means, the image exposure means comprises a unit inside the image forming body, the image forming body being a drum-shaped image forming body in which the outer diameter is 50–100 mm and the image exposure means are located on the circumference of the central angle within 180°.

A color image forming apparatus in which on the periphery of a rotating image forming body, plural sets of image exposure means image-expose a charged image forming body to form a latent image and a developing means forms a toner image after developing the latent image formed on the image forming body during a single rotation of the image forming body. By repeating charging by means of the charging means on the image forming body, image exposure by means of the image exposure means and formation of separate toner images due to development by means of the developing means, the superposed toner image is simultaneously transferred onto a recording medium, wherein the image forming body and the image exposure means housed in the image forming body are integrally formed in an image forming body unit, and the image forming body and the plural developing means can be separated. An open/close cover is mounted above the color image forming apparatus, and while the image forming body unit is loaded in the color image forming apparatus, the plural developing means can be replaced.

A color image forming apparatus, in which on the circumference of the rotating image forming body, plural sets of image exposure means image-expose a charged image forming body to form a latent image and a developing means forms a toner image after developing the latent image formed on the image forming body during one rotation of the image forming body. By repeating charging by means of the charging means on the image forming body, image exposure by means of the image exposure means and formation of separate toner images due to development by means of the developing means, a superposed toner image is simultaneously transferred onto a recording medium, wherein the image forming body and the image forming means housed in the image forming body are integrally formed in an image forming body unit, and the image forming body unit and the plural developing means are integrally formed in a process cartridge such that the processing cartridge can be removed from the color image forming apparatus.

A color image forming apparatus in which on the circumference of a rotating image forming body, plural sets of image exposure means image-expose a charged image forming body to form a latent image and a developing means forms a toner image after developing the latent image formed on the image forming body during one rotation of the image forming body. By repeating charging by means of the charging means on the image forming body image exposure by means of the image exposure means and formation of separate toner images due to development by means of the developing means, a superposed toner image is simultaneously transferred onto a recording medium, wherein the image exposure means is provided housed in the image forming body, and on the outer periphery of the image forming body, the charging means and the developing means are closely located, and wherein a concave section is provided upstream of the rotation of the image forming body, with the concave section being provided with the charging means.

A color image forming apparatus in which on the circumference of a rotating image forming body, plural sets of an image exposure means image-expose a charged image forming body to form a latent image and a developing means forms toner image after developing the latent image formed on the image forming body during one rotation of the image forming body. By repeating charging by means of the charging means on the image forming body, image exposure by means of the image exposure means and formation of separate toner images due to development by means of the developing means, a superposed toner image is simultaneously transferred onto a recording medium, wherein the image exposure means is provided housed in the image forming body, and on the exterior of the image forming body, a charging means and the developing means are mounted.

In order to downsize an image forming apparatus, a one-component type developing device is used. In such case, there occurs the following problems:

(1) When each developing device is located obliquely above the photoreceptor drum and, concurrently with this, the developing roller rotates from upward, the developer tends to be clogged in the vicinity of the control member which regulates the developer layer, which causes problematic development.

(2) When the photoreceptor drum is downsized, developing devices and chargers provided on the circumference of the photoreceptor drum interfere with each other, making it difficult to locate such devices.

A second object of the invention is to overcome these problems (1) and (2).

The first problem is overcome by an image forming apparatus having a developing device composed of a developing roller which develops a latent image on an image forming body, a feeding member which feeds a one-component developer onto the developing roller and a control member which is located downstream of the axis of rotation of the developing roller and which forms a developer layer, wherein the axis of the developing roller is above the center of the image forming body, and an angle $\alpha 1$, formed between a line connecting the center of the photoreceptor drum and the center of the developing roller and a line formed by the center of the developing roller and a counter type connection center of the control member, within 90°±20°. Alternatively, the first problem is overcome by an image forming apparatus having a developing device composed of a developing roller which develops a latent image on an image forming body, a feeding member which feeds one-component developer onto the developing roller and a control member which is located downstream of the rotational axis of the developing roller and which forms a developer layer, wherein the developing roller is above the center of the image forming body, and an angle $\alpha 2$, formed between a line connecting the center of the photoreceptor drum and the center of the developing roller and a line formed by the center of the developing roller and a counter type connection center of the control member, is within 0°±20°.

The second problem is overcome by an image forming apparatus having plural sets of chargers, image exposure means and a developing device, the image forming body being a drum-shaped housing, and the image exposure means and the adjoining developing devices being located within a prescribed angle from the center of the drum.

BRIEF EXPLANATION OF DRAWINGS

FIGS. 3(*a*) and 3(*b*) show schematic explanations of the first embodiment.

DETAILED DESCRIPTIONS OF THE PREFERRED EMBODIMENT

Figure 1:
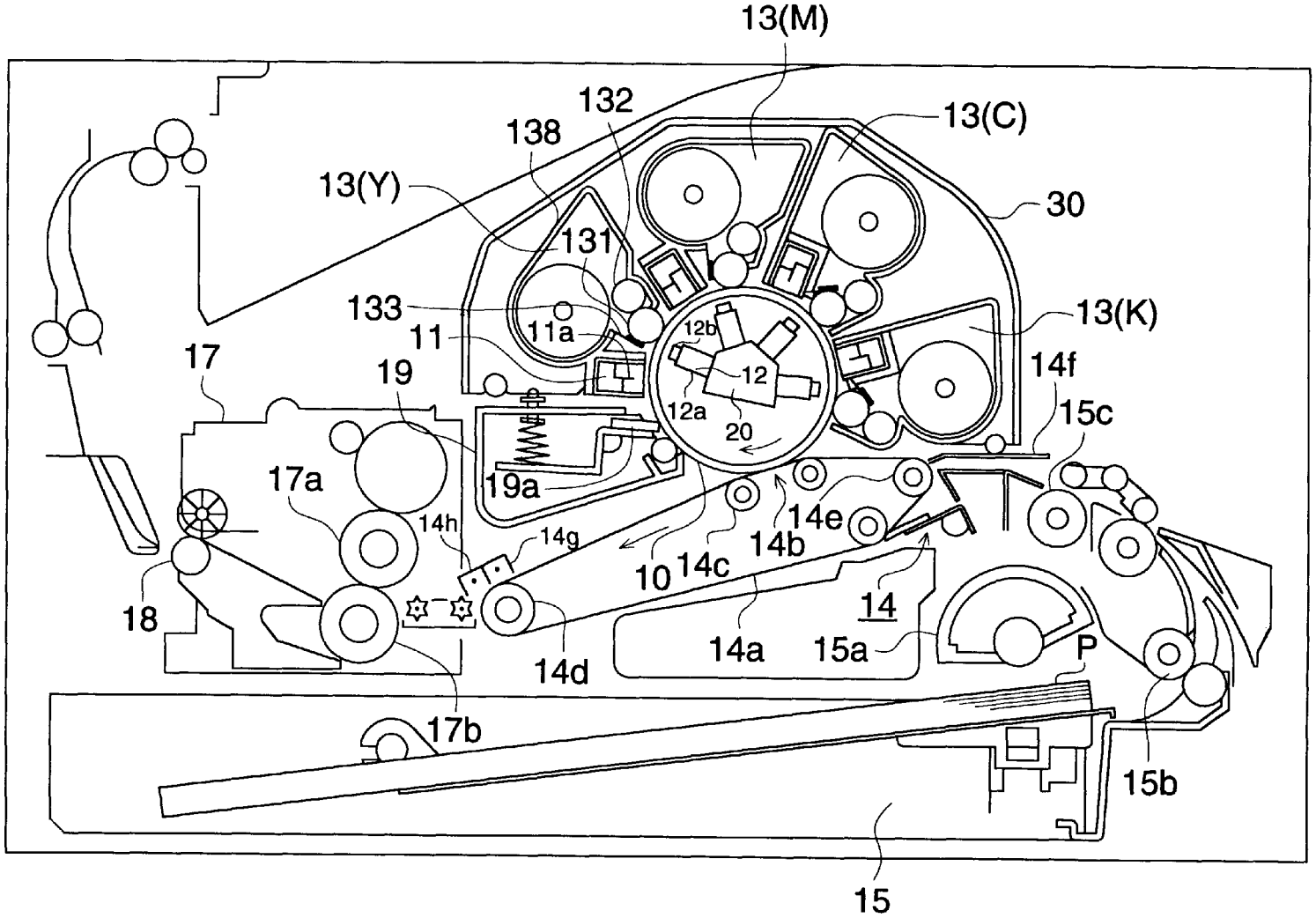
FIG. 1 shows a cross sectional view of a color image forming apparatus used in the present invention.

Prior to the explanation of the embodiment, the constitution and its function of a color image forming apparatus of the present invention will be explained referring to FIG. 1. The color image forming apparatus shown in FIG. 1 is a double-sided image forming apparatus composed of a belt-shaped transfer means, in which a toner image is formed on both surfaces of a recording medium by the use of a belt-shaped member and the toner image is simultaneously fixed. However, the present invention is not limited to forming an image on both surfaces.

Photoreceptor drum 10, which is an image forming body, is provided with a substrate therein formed with a transparent member such as optical glass or transparent acrylic resin and also provided thereon with a transparent conductive layer and further a light-sensitive layer such as an a-Si layer or an organic photosensitive layer (OPC). While electrically grounded, it is rotated in a clockwise direction, as shown by the arrow in FIG. 1.

Scorotron chargers 11, as a charging means, are used for yellow (Y), magenta (M), cyan Q and black image forming processes. The scorotron chargers are mounted to face the photoreceptor drum 10 perpendicular to the movement of photoreceptor drum 10 (which is an image forming body). The photoreceptor drum 10 is composed of a control grid whose potential has been maintained to a prescribed level counter to the organic light-sensitive layer on photoreceptor drum 10 and discharge electrode 11*a* composed of a saw-toothed electrode. The photoreceptor drum 10 conducts a charging effect (negative charging in the present embodiment) by means of corona discharge having the same polarity as the toner. As discharge electrode 11*a*, a wire electrode can also be used.

Exposure unit 12 as an image exposure means for each color is positioned in such a manner that the exposure position on photoreceptor drum 10 is positioned between discharge electrode 11*a* of scorotron charger 11 and the development position of developing device 13.

In exposure unit 12, a bar-shaped exposure element 12*a*, in which a plural number of LEDs (light emission diodes) as an image exposure light emission element arranged in the primary scanning direction parallel to the axis of photoreceptor drum 10 are arranged in an array and a Selfoc lens as a life size image forming element, are constituted as a unit for exposure and mounted on a holder (not illustrated). The exposure unit 12 is housed at the interior of substrate of the photoreceptor drum 10 after being mounted on retention member 20 having a shaft 39 (FIGS. 13, 14, 15, 16). Due to unit structure of an exposure means, downsizing of an image forming body and highly accurate positioning between color toner image become possible. Image data of each color, which is read by a separate image reading device and stored in the memory, is successively read and then inputted into exposure unit 12 for each color as electrical signals.

As an exposure element, in addition to the above, those in which plural emission elements such as FL (fluorescent lighting), EL (electro-luminescence) and PL (plasma discharge) are arranged in an array shape. When an image is exposed from outside the photoreceptor drum, the emission wavelength of the emission element used in the present embodiment is in a range of 780–900 nm in which the transmissive ratio of Y, M and C toner is ordinarily high. However, since the present invention utilizes a system to conduct image exposure from the rear surface, a wavelength of 400–780 nm, which is shorter than the wavelength, which do not have sufficient light transmissivity to color toner.

With regard to the color order in which images are formed and the order of developing devices 13 provided on the rotating photoreceptor drum in accordance with the color order, in the present embodiment, Y and M developing devices 13 are positioned on the left side of photoreceptor drum 10, and C and K developing devices 13 are positioned on the left side of photoreceptor drum 10. Y and M scorotron chargers 11 are positioned below developing casing 138 of Y and M developing devices 13, and C and K scorotron chargers 11 are positioned above developing casing 138 of C and K developing devices 13.

Developing devices 13, as a means for developing each color, respectively house yellow (Y), magenta (M), cyan and black (K) one-component developer. Each developing device keeps a prescribed gap from the circumference of photoreceptor drum 10, which is provided with developing sleeve 131 formed of a cylindrical non-magnetic stainless steel or aluminum at a thickness of 0.3–0.5 mm and whose outer-diameter is 10–20 mm, and which rotates in the identical direction as the rotation of photoreceptor drum 10 at the developing position.

Developing sleeve 131, made of a non-magnetic material such as aluminum and stainless steel, is a developer conveyance carrier supported rotatably in which its surface is subjected to 0.5–5 $\mu$m coarse surface processing by sand blasting processing in terms of indication (JIS-BO610) by means of a 10-points-average-coarseness. Developing sleeve 131 rotates in the same direction as the rotation of photoreceptor drum 10 at the developing position, while keeping a prescribed gap from the circumference of photoreceptor drum 10.

Numeral 132 is a supply roller which functions as a toner supplying member which supplies a developer (toner) to developing sleeve 131 and which rotates in the same direction as developing sleeve 131, composed of foaming material such as sponge and urethane rubber and provided axially parallel to developing sleeve 131 in the supplying section. Numeral 133 is a control member for regulating the height and quantity of the developer layer (toner layer), and is composed of a band-shaped elastic plate 133*a* (FIGS. 3(*a*), 3(*b*), 6, 7(*a*), 7(*b*)) or 233*a* (FIGS. 5(*a*), 5(*b*), 8, 9(*a*), 9(*b*)) composed of a plate-shaped stainless steel and a rubber material and a band-shaped elastic body 133*b* (FIGS. 3(*a*). 3(*b*), 6, 7(*a*), 7(*b*)) or 233*b* (FIGS. 5(*a*), 5(*b*), 8, 9(*a*), 9(*b*)) mounted at the contact portion of developing sleeve 131 at the leading end of the elastic plate 133*a* (233*a*), and composed of a foaming material such as sponge and urethane rubber.

In the development region on developing sleeve or roller 131, or upstream in the rotation direction of developing roller 131 compared to developing roller 131, developing control electrode 135 in which the leading end thereof is brought into contact with the toner layer is provided. Developing control electrode 135, located parallel to the longitudinal direction of developing roller 131, is a plate-shaped member mounted on developing casing or container 138, in which a bar-shaped electrode having 50–500 $\mu$m width and 1–100 $\mu$m thickness composed of a conductive material such as a metal which is parallel to the insulating member and whose surface is coated with an insulating material at the leading end of the insulating member composed of an insulating material is integrally provided. By providing developing control electrode 135, developability is improved. It goes without saying that developing device 13 has a structure to omit developing control electrode 135.

Numeral 134 is a hopper section housing a developer, which is enclosed in developing container 138. Inside hopper section 134, lever-shaped stirring member 134*a* which rotates clockwise is provided inside hopper section 134. Following development operation, stirring member 134*a* is rotated, a developer inside hopper section 134 is stirred and conveyed for replenishing the developer. On developing casing or container 138, protrusion section 138*a* which protrudes to inside along the operation region of stirring member 134*a*. Control member 133 is mounted and supported on protrusion section 138*a*. Developer conveyed out from hopper section 134 is subjected to triboelectric charging among developing roller 131, control member 133 and supply roller 132.

Developing device 13 is kept out of contact with photoreceptor drum 10 having a gap of 100–500 μm by means of a contact roller (not illustrated). In developing effect by means of developing device 13 for each color, a developing bias of DC voltage or DC voltage in which AC voltage is added thereto additionally is impressed onto developing sleeve 131. Jumping development by a one-component developer housed in a developing device is conducted. D.C. bias having the sale polarity as in toner (in the present embodiment, a negative polarity) is impressed to photoreceptor drum 10 having negative charge. Non-contact reversal development in which toner is adhered onto an exposure section is conducted. With regard to development interval accuracy here, 20 μm or less is necessary in order to prevent uneven image.

The developing devices 13, one for each color reversely develop electrically static latent images, on photoreceptor drum 10, formed by charging by means of the scorotron charger 11 and image exposure by exposure unit 12 using a toner having the same polarity as the charged polarity under non-contact status by means of a non-contact developing method due to impressing of identical polarity of development bias (in the present embodiment, the photoreceptor drum is a negative charge, and the polarity of the toner is negative).

As a one-component developer (toner) used in the developing device, spherical or amorphous non-magnetic toner obtained by the same method as a conventional method can be used. The preferable toners employ resin such as a styrene-containing resin, a vinyl-containing resin; an ethylene-containing resin, a rhodine-denatured resin, an acrylic-containing resin, a polyamide resin, an epoxy resin and a polyester resin and resins such as fatty acid wax including palmitine acid and stearic acid. To the resin, a coloring component such as a color pigment and a charge controller, as necessary, are added to form toner by means of an identical method as a conventional toner particle manufacturing method. The average particle size is ordinarily 20 μm, preferably 10 μm, or less and specifically preferably 1–7 μm. In addition, as necessary, a fluidity-enhancer which improves the fluidity lubrication of particles and a cleaning agent which is helpful in the cleaning of the image carrier surface. As a fluidity-enhancer, colloidal silica, silicone wax, metallic soap or a non-ion surfactant can be used. As a cleaning agent, a surfactant, such as fatty acid metallic salts, organic group substituted silicones or fluorines can be used.

A one-component developer (toner) is tightly closed in developing device 13. When it is consumed, it is replaced as a developing device. The toner is subjected to frictional charging among developing sleeve 131, control member 133 and supply roller 132.

An image read by an image sensor in an image reading device separately provided from the main apparatus or a image edited by a computer as an original image is temporarily stored on the memory as image data for each of Y, M, C and K to be housed.

When starting image recording, due to starting the motor for driving the photoreceptor (not illustrated), photoreceptor drum 10 is rotated in an arrowed direction in FIG. 1. Simultaneously, due to charging effect of Y scorotron charger located at the left side of photoreceptor drum 10 and below developing casing 138 of yellow (Y) developing device 13 provision of potential onto photoreceptor drum 10 is started.

In photoreceptor drum 10, after potential is provided, exposure, by means of electrical signals, which correspond to the first color signal, i.e., Y image data started in Y exposure unit 12. Due to rotation scanning of photoreceptor drum 10, an electrostatic latent image, which corresponds to the Y image of an original image, is formed on the surface of the photosensitive layer.

The latent image is subjected to reversal developing under non-contact condition using a developer on the development roller in developing device 13 so that, depending upon the rotation of photoreceptor drum 10, yellow (Y) toner image is formed.

Next, in photoreceptor drum 10, potential is provided on the yellow (Y) toner by means of charging effect by a magenta (M) scorotron charger 11 located left of photoreceptor drum 10, on the yellow developing device 13 and below developing casing 138 of magenta (M) developing device 13. Exposure by means of an electrical signal which corresponds to the M image data, i.e., the second color signal of M exposure unit 12 is conducted. Accordingly, a magenta (M) toner image is superposed on the yellow (Y) toner image, formed due to non-contact reversal development by M developing device 13.

Similarly, a cyan (C) toner image which corresponds to the third color signal is superposed to be formed by means of the cyan (C) scorotron charger 11 located right of photoreceptor drum 10 and above developing casing 138 of the cyan (C) developing device 13, C exposure unit 12 and C developing device 13. In addition, a black (K) toner image which corresponds to the fourth color signal is superposed to be formed by means of the black (K) scorotron charger 11 located right of photoreceptor drum 10 and below developing casing 138 of the cyan (C) developing device 13, K exposure unit 12 and K developing device 13.

Exposure on the organic photosensitive layer of photoreceptor drum 10, by the Y, M, C ad K exposure unit 12 is conducted through the transparent substrate from the interior of the drum. Accordingly, image exposure corresponding to the second, third and fourth color signal is conducted not receiving any influence by the toner image previously formed, in which identical electrostatic latent images in the same manner as the image corresponding to the first color signal is possible.

A superposed color toner image in which an image is formed on the rear surface is formed on photoreceptor drum 10 (an image forming body). The superposed color toner image in which a rear image on photoreceptor drum 10 is formed is extended around between driving roller 14*d* and driven roller 14*e* at transfer region 14*b* by means of transfer device 14*c* (the first transfer means) to which a DC voltage having the reverse polarity (the positive polarity, in the present embodiment) as the toner is applied, and the toner is simultaneously transferred onto toner image receiving body 14*a* (an intermediate transfer body) provided in the vicinity of or in contact with photoreceptor drum 10.

Toner remaining on the circumference of photoreceptor drum 10 after transferring reaches cleaning device 19. By means of cleaning blade 19*a* composed of rubber material which is brought into contact with photoreceptor drum 10, the photoreceptor drum 10 is cleaned. Successively, color image formation of the next surface image is conducted.

After a superposed color toner image in which an image is formed on the rear surface is formed on toner image receiving body 14*a* as described above, the superposed toner image which will be the surface image is successively formed in the same manner as in the color image forming process. In this occasion, a rear surface image formed on toner image receiving body 14*a* and a surface image formed on photoreceptor drum 10 are synchronous on transfer region 14*b* so that a toner image on both surfaces can be formed. It is necessary for a surface image formed in this occasion to modify image data in such a manner that it will compose a mirror image with a rear image formation on photoreceptor drum 10.

Recording paper P, a recording medium, is fed out from paper feeding cassette 15 which is a recording medium housing means using feeding roller 15*a*. The recording paper P is conveyed to timing roller 15*c* by means of paper feeding roller 15*b*.

Recording paper P is fed to transfer region 14*b* by means of driving by timing roller 15*c*, while the color toner image on the surface image carried on photoreceptor drum 10 is synchronized with the color toner image on the rear surface carried on toner image receiving body 14*a*. In this occasion, recording paper P is subjected to paper electrification to the polarity the same as toner by means of paper charger 14*f*, which is a recording medium charging means, and the recording paper P is fed to transfer region 14*b* while being absorbed by toner image receiving body 14*a*. By conducting paper charging to the same polarity as the toner, drawing by recording paper P with toner image on toner image receiving body 14*a* and the toner image on photoreceptor drum 10 at other than the transfer region is prevented and thereby disturbance of toner image is prevented. As a recording medium charging means, a conductive roller, a brush charger and a corona charger each of which can be brought into contact with and which can also be released from contact with the toner image receiving body 14*a*.

Surface images on the circumference of photoreceptor drum 10 are simultaneously transferred onto the upper surface (the surface side) of recording paper P, by means of transfer device 14*c* as a first transfer means to which voltage having an opposite polarity (a positive polarity, in the present embodiment) is impressed. In this occasion, a rear surface image on the circumference of toner image receiving body 14*a* is not transferred onto recording paper P, remaining on toner image receiving body 14*a*. Next, the rear surface on the circumference of toner image receiving body 14*a* is transferred onto the lower surface (a rear surface side) of recording paper P simultaneously by means of rear surface transfer device 14*g* as a second transfer means in which polarity having an opposite voltage (a positive voltage in the present embodiment) as toner.

Since toner images of each color are superposed on each other, in order to make possible simultaneous transferring, it is preferable that a toner of the upper layer and a toner of a lower layer in the toner layer are charged to the same polarity at the same charge amount. With regard to the double-sided image formation in which inversion of a color toner image formed on toner image receiving body 14*a* is conducted by corona discharge or inversion of the color toner image formed on photoreceptor drum 10 is conducted by means of corona discharge, it is not preferable since transfer of the image is insufficient since the toner of the lower layer is not sufficiently charged at the same polarity.

It is, however, preferable to simultaneously transfer a color toner image having the same polarity in which reversal development is repeated on photoreceptor drum 10 and the resulting images are superposed to be formed onto a toner image receiving body 14*a* without changing polarity and then to simultaneously transfer the images on recording paper P without changing polarity, since it contributes to improvement of transfer property of image formation on the rear surface. With regard to image formation on the front surface, it is preferable to simultaneously transfer a color toner image having the same polarity in which reversal developments repeated on photoreceptor drum 10 and the resulting images are superposed to be formed onto toner image receiving body 14*a* without changing polarity and then to simultaneously transfer the images onto recording paper P without changing polarity, since it contributes to improvement of transfer property of image formation on the front surface.

During color image formation, a double-sided image forming method, in which a first transfer means is actuated and then a color toner image is formed on the surface of the recording medium by the use of the front surface and rear surface image forming method and a second transfer means is actuated and then a color toner image is formed on the surface of the recording medium, is preferably adopted.

Toner image receiving body 14*a* is an endless rubber belt having 0.5 to 2.0 mm thickness, composed of a semiconductor substrate composed of a silicone rubber or a urethane rubber having $10^8$ through $10^{12}\Omega$ and a fluorine-coated layer having 5–50 $\mu$m as a toner filming prevention layer outside the rubber substrate. Similarly, the layer preferably has semiconductor properties. In place of a rubber belt substrate, a semiconductor polyester, polystyrene, polyethylene, polyethyleneterephthalate and polyimide respectively having 0.1–0.5 mm thickness.

Recording paper P in which color toner images are formed on both surfaces thereof is discharged by means of paper separation AC discharger 14*h* (hereinafter, referred also as a separation pole) for separating a recording medium, is separated from toner image receiving body 14*a* and conveyed to fixing device 17, as a fixing means, constituted with two rollers each having a heater therein. By applying heat and pressure between fixing roller 17*a* and application roller 17*b*, adhered toner on the front surface and the rear surface of recording paper P is fixed. Recording paper on which images are respectively recorded on both surfaces is fed from paper ejection roller 18, and discharged to the tray outside the apparatus.

Toner remaining on the circumference of toner image receiving body 14*a* after being transferred is cleaned off by a blade provided on toner image receiving body cleaning device 14 (FIGS. 1, 13, 15, 16), as a cleaning means and capable of being brought into contact with and released from contact with toner image receiving body 14*a*. In addition, toner remaining on the circumference of photoreceptor drum 10 after being transferred reaches cleaning device 19. The toner is scraped off into cleaning device 19 by means of cleaning blade 19*a* composed of a rubber material being brought into contact with photoreceptor drum 10, and then collected by a waste toner container (not illustrated). Photoreceptor drum 10 from which residual toner was removed by means of cleaning device 19 is subjected to uniform charging by means of Y scorotron charger 11, and then enters into the next image formation cycle.

Since the above-mentioned method employs simultaneous transfer of superposed color toner image, color deviation of color image and scattering and squeezing of toner on toner image receiving body are difficult to occur and thereby a favorable double-sided color image having little image deterioration is formed.

Due to downsizing of each of the exposure units 12 housed in the photoreceptor drum 10, a small size drum having an outer diameter of 50 mm to 100 mm is used for the photoreceptor drum. Due to this, downsizing of the apparatus has been realized. If the outer diameter is 50 run or less, it is impossible to locate exposure unit 12 inside photoreceptor drum 10 and also provide 4 sets of scorotron chargers 11 and developing devices 13. In addition, if the outer diameter is 100 mm or more, separation performance of the recording medium from photoreceptor drum 10 is reduced. Accordingly, time necessary for image formation requires too much. In addition, depending upon accuracy and deformation of the photoreceptor drum, accuracy in terms of alignment is also reduced.

If the diameter of photoreceptor drum 10 is too small, formation of paper feeding system of recording paper P becomes difficult depending upon the results of the layout of exposure unit 12 and developing device 13. In the present invention, however, owing to each example explained hereinafter, well-balanced location of exposure unit 12 and developing device 13 are made so that the paper feeding system of recording paper P is arranged almost horizontally. Thus, an apparatus capable of ensuring transfer of image and conveyance property of recording paper is realized.

Each of the above-mentioned developing device 13 shown in an embodiment shown in FIG. 1 is built in cartridge 30 after fixing charger 11 on the external wall of each container. By detaching each cartridge 30 horizontally from the front side of FIG. 1, each developing device 13 is integrally detached with charger 11 on the apparatus main body.

EMBODIMENT 1

With regard to the color order in which images are formed and the order of developing devices 13 provided on the rotating photoreceptor drum in accordance with the color order, in the present embodiment, Y and M developing devices 13 are positioned on the left side of photoreceptor drum 10, and C and K developing devices 13 are positioned at the left side of photoreceptor drum 10. Y and M scorotron chargers 11 are positioned below developing casing 138 of Y and M developing devices 13, and C and K scorotron chargers 11 are positioned above developing casing 138 of C and K developing devices 13.

Developing devices 13, as a means for developing each color, respectively house yellow (Y), magenta (M), cyan (C) and black (K) one-component developer. The developing devices are located above the center of photoreceptor drum 10, and keep a prescribed distance with the circumference of the photoreceptor drum 10. In addition, the developing device 13 is provided with developing roller 131 which rotates in the same direction as rotation of photoreceptor drum 10 at the developing position. Accordingly, developing rollers 131 in Y and M developing device 13 move upward in developing region. In addition, developing rollers 131 in C and K developing device 13 moves downward in developing region. Y and M developing devices 13 have a developing region at a region where the developing rollers move from upward.

Y and M developing devices are respectively provided with developing control electrode 135 which is brought into contact with a developer layer (toner layer) on developing roller 131 at the developing region or upstream in the rotation of developing roller 131. Developing control electrode 135 is a plate member located parallel in the longitudinal direction of developing roller 131 and mounted on developing container 138.

Figure 2:
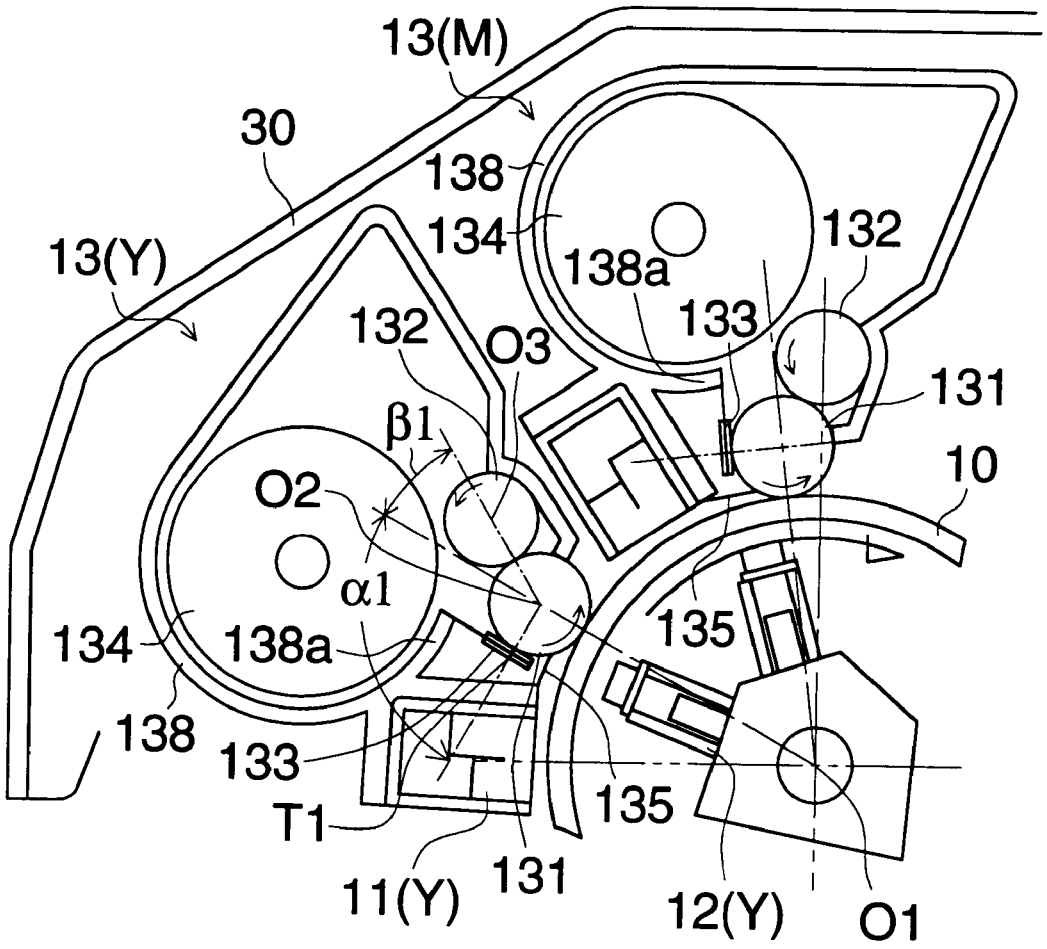
FIG. 2 shows a cross sectional view of a developing device of the first embodiment.

In the present invention, Y and M developing devices of the present embodiment will be explained referring to FIGS. 2 and 3(*a*) and 3(*b*). FIG. 2 is a cross sectional view of a developing device of the first embodiment. FIGS. 3(*a*) and (*b*) are an explanation showing circulation state in the vicinity of the control members of a developer.

In the present embodiment, control member 133 is a so-called trail-type control member in which the front end is directed to the downstream of the rotation of developing roller 131.

In developing device 13 of the present embodiment angle $\alpha 1$ formed by a line 01–02 composed of point 01 which is the center of photoreceptor drum 10 which rotates from upward in the developing region and point 02 which is the center of developing roller 131 which rotates from upward in the developing region and a contact center T1 of trail type control member 133 provided on the upstream side of the developing region in the rotational direction of developing roller 131 is preferably 90°±20° and more preferably 90°±15°. If the angle $\alpha 1$ is smaller than 75°, replenishment of toner tends to be insufficient. If an angle $\alpha 1$ is larger than 105°, toner tends to be clogged at the inlet portion of control member 133.

Angle $\beta 1$ formed by the line 01–02 which connects the center 01 of photoreceptor drum 10 and center 02 of developing roller 131 and line 02–03 formed by 02 which is the center of developing roller 131 and 03 which is the center of supply or feeding roller 132 which rotates in the same direction (counterclockwise in FIG. 2) as developing roller 131 is preferably 35°±20°, and more preferably 35°±15°. See FIGS. 3(*a*) and 3(*b*). Toner fed from hopper section 134 forms a circulation path shown, by an arrow, by means of developing roller 131 and feeding roller 132. The frictionally charged toner abrided and charged moves to control member 133 to be fed. If an angle $\beta 1$ is larger than 50°, the circulation path is farther from control member 133 so that toner in which charging is insufficient is fed. To the contrary, if $\beta 1$ is smaller than 20°, toner circulates in a narrow range so that toner is fed to control member 133 while it is not charged sufficiently.

In the present embodiment, by setting $\alpha 1$ to be 90°±15° and $\beta 1$ to be 35°±15°, space can effectively be utilized, and thereby developing device 13 becomes compact. Accordingly, at the developing region, toner is not clogged in the vicinity of the control member against the developing roller 131 which moves upward. Therefore, feeding and control of one-component developer becomes favorable. As a result, a uniform developer thin layer (toner layer) is formed by the frictionally charged toner abrided and charged, thereby a favorable image having no image unevenness and incomplete image formation can be obtained.

EMBODIMENT 2

Figure 4:
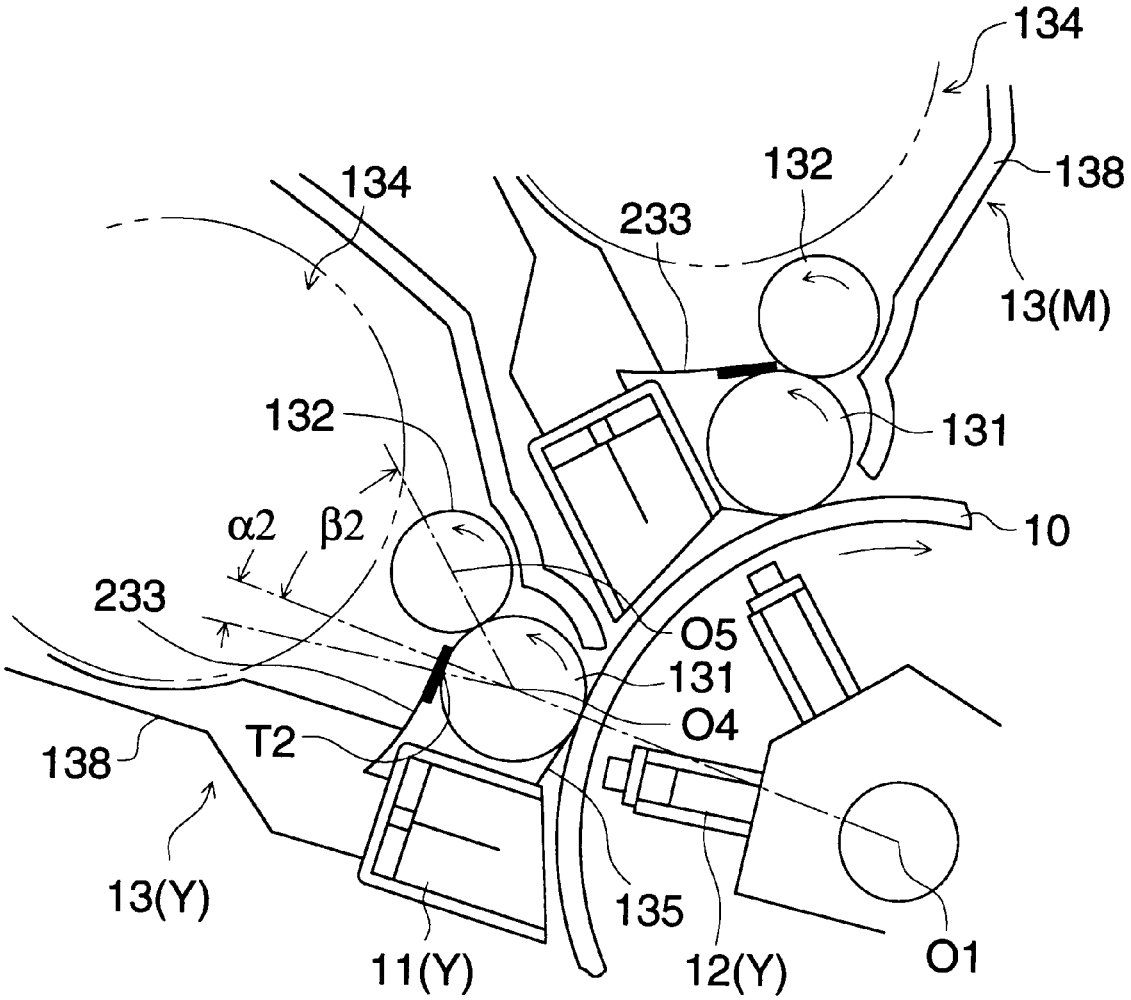
FIG. 4 shows a cross sectional view of a developing device of the second embodiment.
Figure 5:
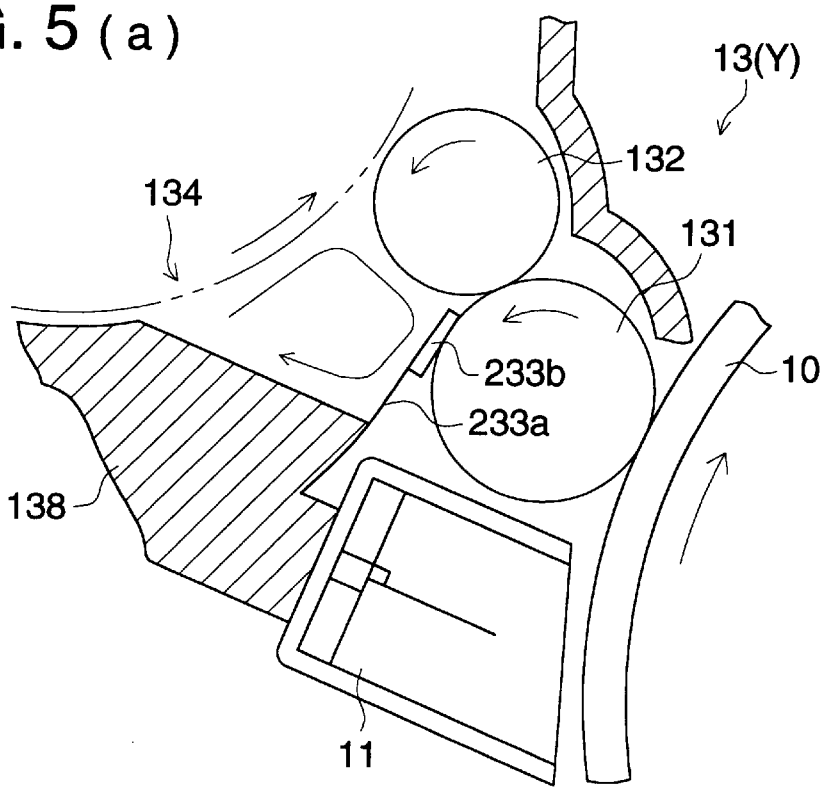
FIGS. 5(*a*) and 5(*b*) show schematic explanations of the second embodiment.
Figure 5:
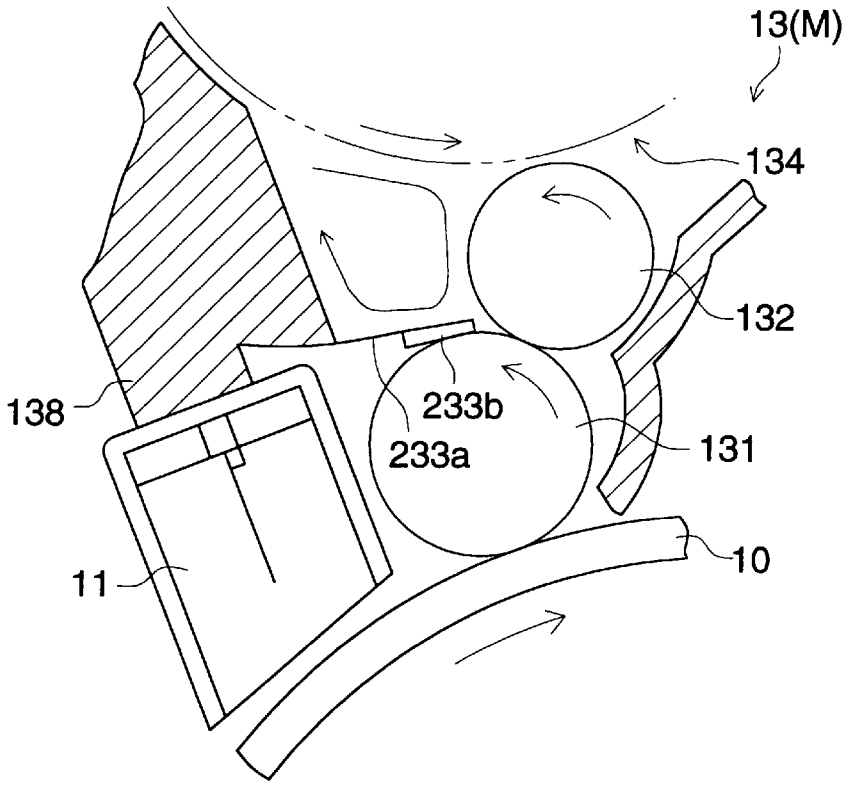

In the present invention, the second embodiment of Y and M developing devices will be explained referring to FIGS. 4 and 5(*a*) and 5(*b*). FIG. 4 shows a cross sectional view of a developing device of the second embodiment. FIGS. 5(*a*) and 5(*b*) are explanations showing a state of developer circulating in the vicinity of the control member. With regard to members having the same function and the same structure as in the first embodiment, identical numerals are provided.

Control member 233 of the present invention is a so-called counter type control member in which the leading end thereof is directed to the upstream of rotation of developing roller 131.

In developing device 13 of the present embodiment, an angle α2 formed by a line 01–04 in which point 01 is the center of the photoreceptor drum which rotates from upward in the developing region and point 04 is the center of developing roller 131 which rotates from upward and a line 04–T2 in which point 04 is the center of developing roller 131 and contact center T2 of counter type control member 233 provided on the upstream side of developing region in the direction of rotation of developing roller 131 is preferably 0°±20° and more preferably 0°±15°. If angle α2 is −15° or less, feeding roller 132 is brought into contact with the leading end portion of control member 233 so that toner tends to be clogged. As a result, control of the layer thickness becomes unstable. In addition, if angle α2 is ±15° or more, feeding of the toner onto control member 233 becomes insufficient.

In addition, angle β2 formed by line 01–04 in which point 01 is the center of photoreceptor drum 10 and point 04 is the center of developing roller 131 and line 04–05 in which point 04 is the center of developing roller 131 and point 05 is a point which is the center of feeding roller 132 which rotates in the same direction (counterclockwise) as the rotation of developing roller 131 is preferably 40°±20° and more preferably 40°±15°. See FIGS. 5(*a*) and 5(*b*). Toner fed onto feeding roller 132 from hopper section 134 forms a circulation path shown, by an arrow, by means of developing roller 131 and feeding roller 132. The frictionally charged toner abrided and charged moves to control member 233 to be fed. If an angle β2 is larger than 55°, the circulation path is farther from control member 233 so that toner in which charging is insufficient is fed. To the contrary, if β2 is smaller than 25°, toner circulates in a narrow range so that toner is fed to control member 133 while it is not charged sufficiently.

In the present embodiment, by setting α2 to be 0°±15° and β2 to be 40°±15°, space can effectively be utilized, and thereby developing device 13 becomes compact. Accordingly, at the developing region, toner is not clogged in the vicinity of the control member against the developing roller 131 which moves upward. Therefore, feeding and control of one-component developer becomes favorable. As a result, a uniform developer thin layer (toner layer) is formed by toner abrased and charged, thereby a favorable image having no image unevenness and incomplete image formation can be obtained.

EMBODIMENT 3

A developing device of the image forming apparatus of the present invention has a developing region in a region in which developing roller 131 moves from downward. Namely C and K developing device 13 of the present embodiment in a color image forming apparatus of the present explanation.

In the development region on developing roller 131, or on upstream in the rotation direction of developing roller 131 compared to developing roller 131, developing control electrode 135 in which the leading end thereof is brought into contact with the toner layer is provided. Developing control electrode 135, located parallel to the longitudinal axis of developing roller 131, is a plate-shaped member mounted on developing container 138.

Figure 6:
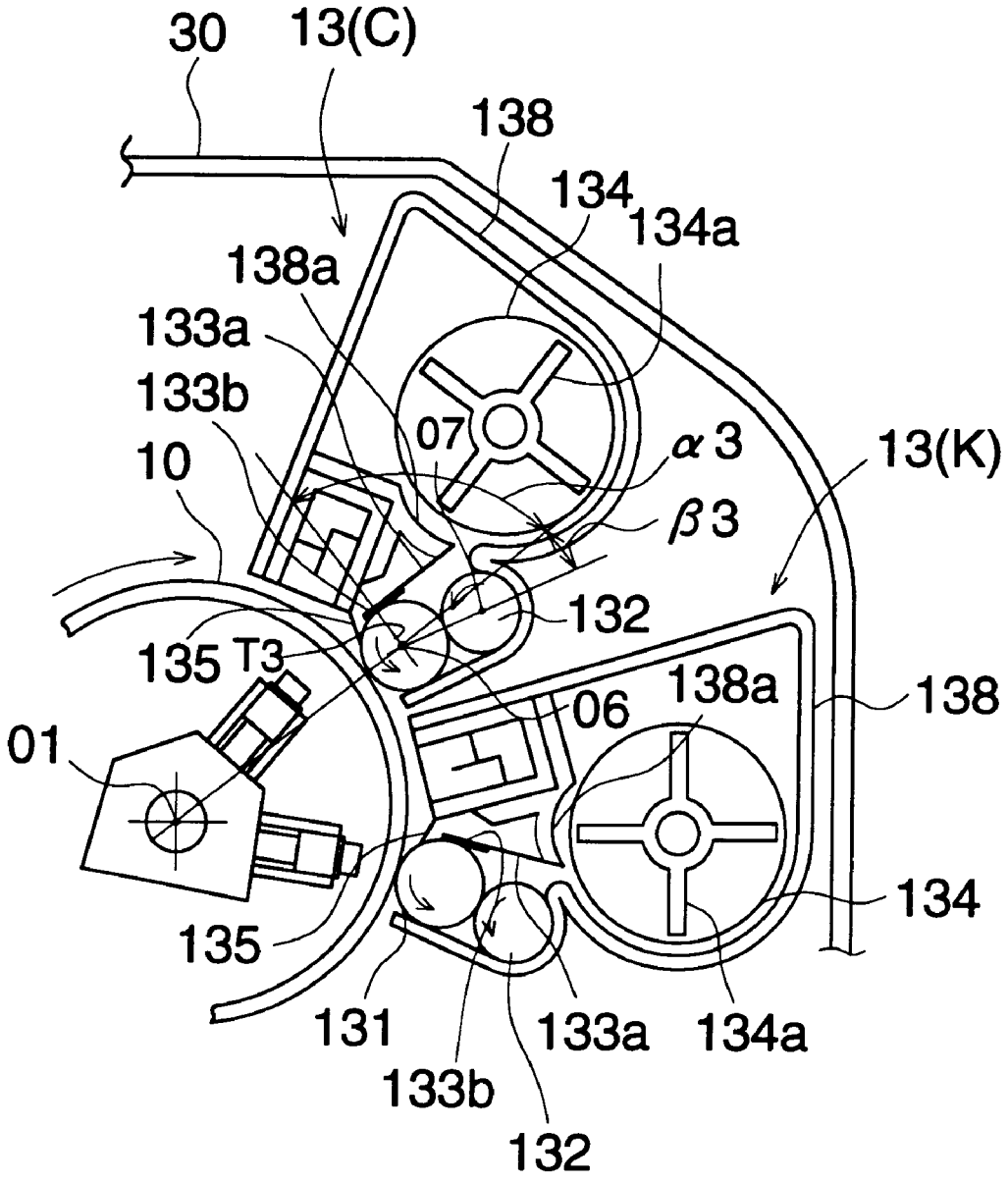
FIG. 6 shows a cross sectional view of a developing device of the third embodiment.
Figure 7:
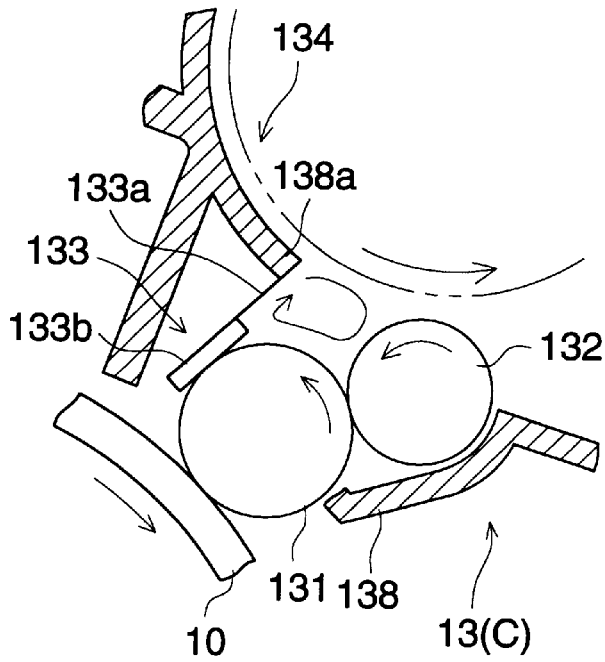
FIGS. 7(*a*) and 7(*b*) show schematic explanations of the third embodiment.
Figure 7:
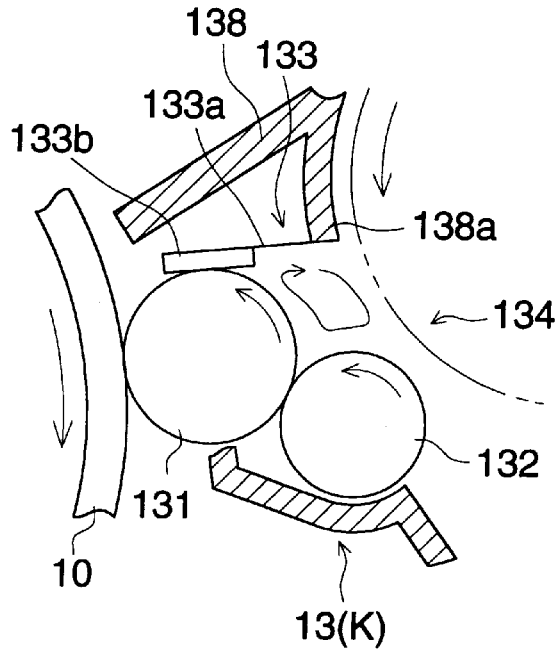

C and K developing devices of the third embodiment of the present invention will be explained referring to FIGS. 6 and 7(*a*) and 7(*b*). FIG. 6 is a cross sectional view of a developing device of the third embodiment. FIGS. 7(*a*) and 7(*b*) are an explanation showing circulation state in the vicinity of the control members of a developer.

In developing device 13 of the present embodiment, angle α3 formed by line 01–06 composed of point 01 which is the center of photoreceptor drum 10 which rotates from upward in the developing region and point 06 which is the center of developing roller 131 which rotates from upward in the developing region and a contact center T3 of trail type control member 133 provided on the upstream side of the developing region in the direction of rotation of developing roller 131 is preferably 90°±20° and more preferably 90°±15°. If the angle α3 is smaller than 75°, replenishment of toner tends to be insufficient. If angle α3 is larger than 105°, toner tends to accumulate at the inlet portion of control member 133.

Angle β3 formed by the line 01–06 which connects the center 01 of photoreceptor drum 10 and the center 06 of developing roller 131 and line 06–07 formed by 06 which is the center of developing roller 131 and 07 which is the center of feeding roller 132 which rotates in the same direction (counterclockwise in FIG. 2) as developing roller 131 is preferably 35°±20°, and more preferably 35°±15°. See FIGS. 3(*a*) and 3(*b*). Toner fed from hopper section 134 forms a circulation path shown, by an arrow, by means of developing roller 131 and feeding roller 132. The toner abrased and charged moves to control member 133 to be fed. If angle β3 is larger than 50°, the circulation path is farther from control member 133 so that toner in which charging is insufficient is fed. To the contrary, if β3 is smaller than 20°, toner circulates in a narrow range so that toner is fed to control member 133 while it is not charged sufficiently.

In the present embodiment, by setting α3 to be 90°±15° and β3 to be 35°±15°, space can effectively be utilized, and thereby developing device 13 becomes compact. Accordingly, at the developing region, toner is not clogged in the vicinity of the control member against the developing roller 131 which moves upward. Therefore, feeding and control of one-component developer becomes favorable. As a result, a uniform developer thin layer (toner layer) is formed by toner abrased and charged, thereby a favorable image having no image unevenness and image spot can be obtained.

EMBODIMENT 4

Figure 8:
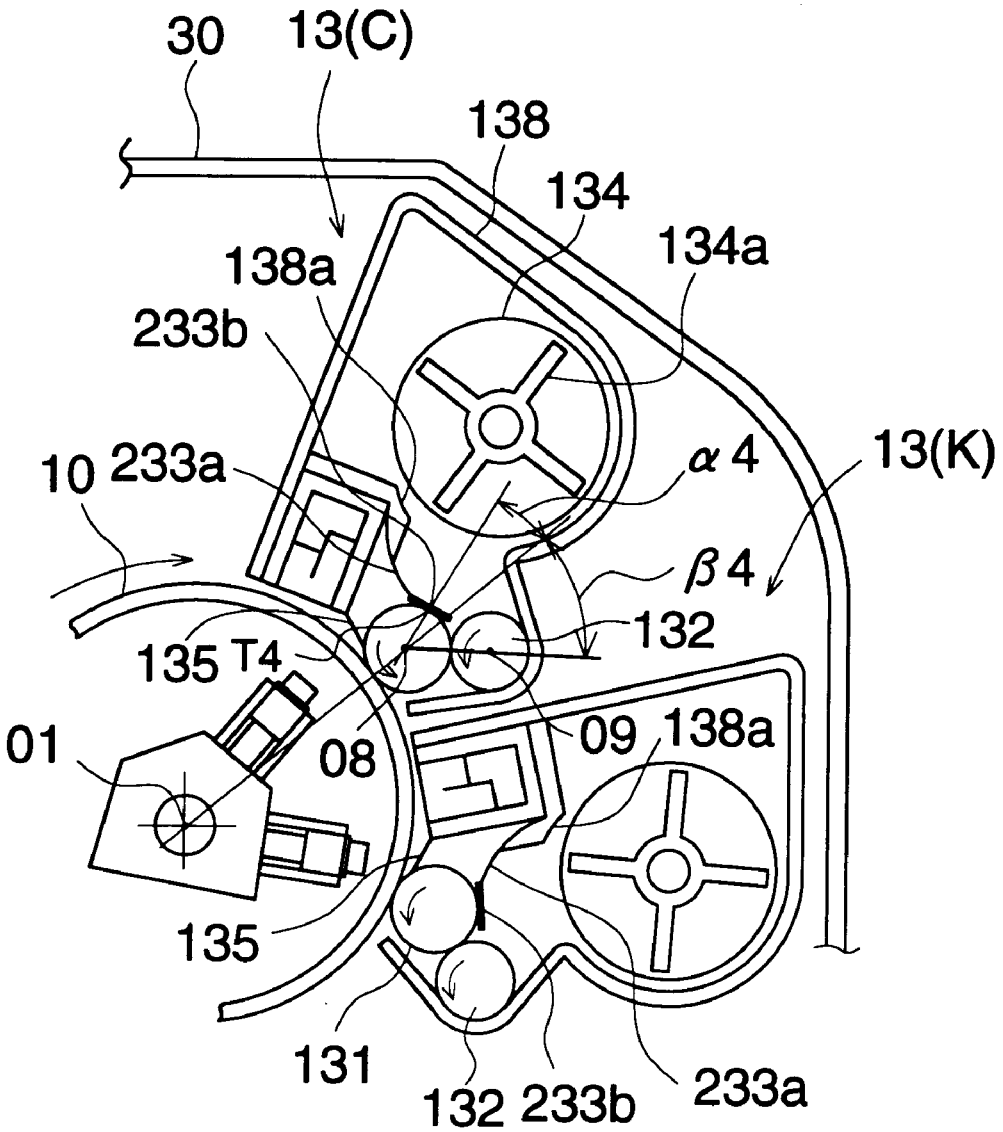
FIG. 8 shows a cross sectional view of a developing device of the fourth embodiment.
Figure 9:
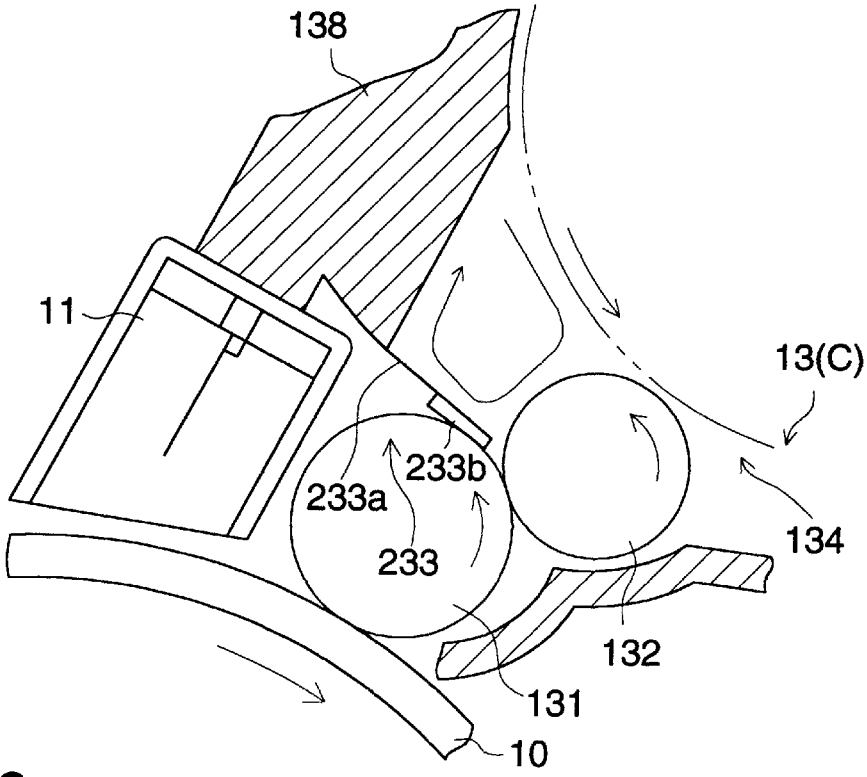
FIGS. 9(*a*) and 9(*b*) show schematic explanations of the fourth embodiment.
Figure 9:
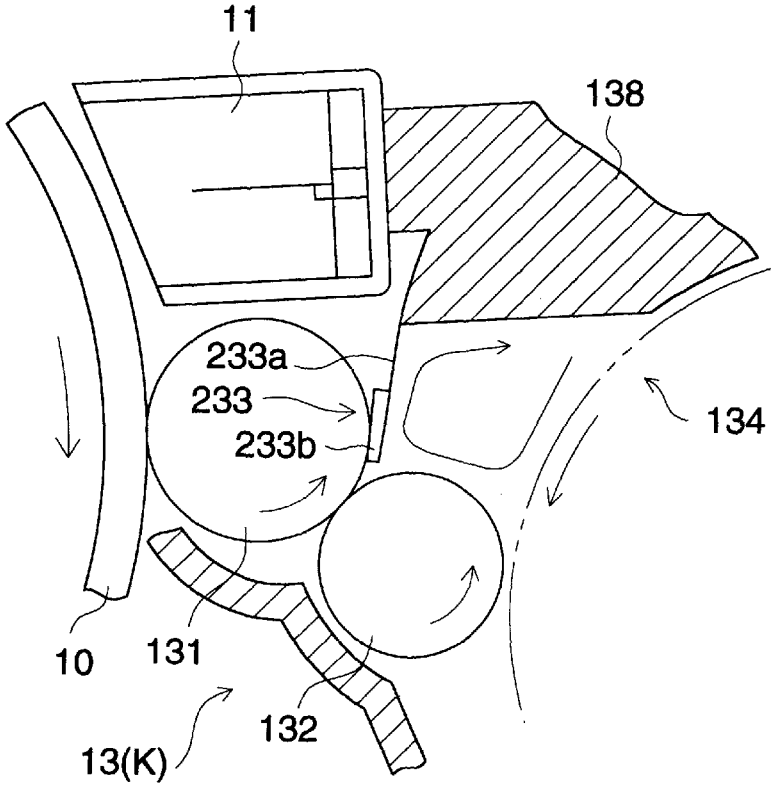

In the present invention, C and K developing devices of the present embodiment will be explained referring to FIGS. 8 and 9(*a*) and 9(*b*). FIG. 8 is a cross sectional view of developing device of the fourth embodiment. FIGS. 9(*a*) and 9(*b*) are an explanation showing circulation state in the vicinity of the control members of a developer. Incidentally, members having the same function and structure as the fourth embodiment are applied to the same numerals.

In developing device 13 of the present embodiment, angle α4 formed by line 01–08 in which point 01 represents the center of photoreceptor drum 10 which rotates downward in a developing region and point 08 represents the center of developing roller 131 which rotates downward in the developing region and line 08–T4 in which point 08 represents the center of developing roller 131 and point T4 represents a contact center of a counter type control member 233 provided upstream of the developing region in the direction of rotation of developing roller 131 is arranged to be 0°±20° and preferably 0°±15°. If angle α4 is −15° or less, feeding roller 132 and the end portion of control member 233 are brought into contact with each other. As a result, toner tends to be clogged so that control of the layer thickness of the toner become unstable. In addition, if angle α4 is +15° or more, feeding of the toner onto control member 233 becomes insufficient.

In addition, an angle β4 formed by line 01–08 in which point 01 is the center of photoreceptor drum 10 and point 08 is the center of developing roller 131 and line 08–09 in which point 08 is the center of developing roller 131 and point 09 is a point which is the center of feeding roller 132 which rotates in the same direction (counterclockwise) as the rotation of developing roller 131 is preferably 40°±20° and more preferably 40°±15°. See FIGS. 9(*a*) and 9(*b*). Toner fed onto feeding roller 132 from hopper section 134 forms a circulation path shown, by an arrow, by means of developing roller 131 and feeding roller 132. The toner abrased and charged moves to control member 233 to be fed. If the angle β4 is larger than 55°, the circulation path is farther from control member 233 so that toner in which charging is insufficient is fed. To the contrary, if β4 is smaller than 25°, toner circulates in a narrow range so that toner is fed to control member 133 while it is not charged sufficiently.

In the present embodiment, by setting α4 to be 0°±15° and β4 to be 40°±15°, space can effectively be utilized, and thereby developing device 13 becomes compact. Accordingly, at the developing region, toner is not clogged in the vicinity of the control member against the developing roller 131 which moves upward. Therefore, feeding and control of one-component developer becomes favorable. As a result, a uniform developer thin layer (toner layer) is formed by toner abrased and charged, thereby a favorable image having no image unevenness and image spot can be obtained.

As an apparatus for explaining embodiments 1 through 4, an internal image exposure type in which plural image exposure means are provided inside of an image forming body is employed. In addition, an external image exposure type in which plural image exposure means are provided outside of an image forming body is employed.

EMBODIMENT 5

Figure 10:
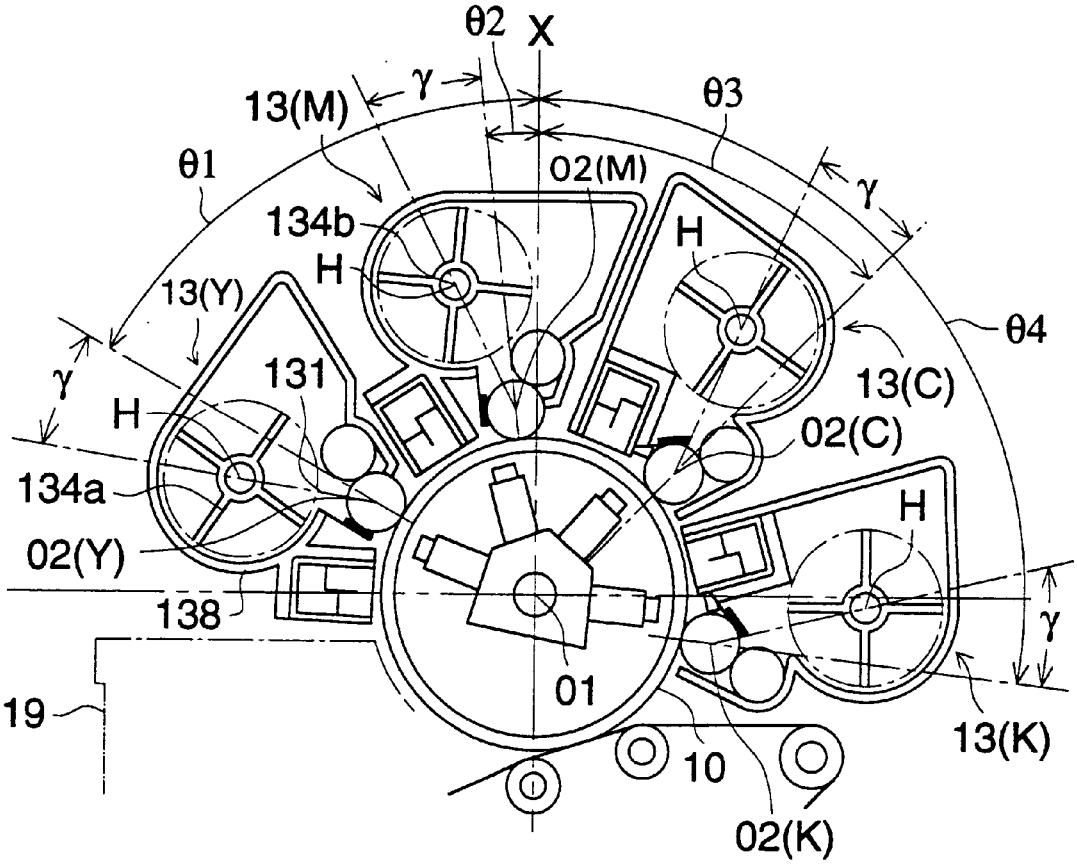
FIG. 10 shows a location explanation drawing of the fifth embodiment.

In the present embodiment, Y developing device 13 (Y) and M developing device 13 (M) respectively having integral scorotron chargers 11 are common having the same form. In addition, C developing device 13 (C) and K developing device 13 (K) respectively having integral scorotron chargers 11 are common having the same form. In the image forming apparatus of the present embodiment, commonality of developing device 13(Y) and 13(M), and that of developing device 13(C) and 13(K) are contrived. On a small photoreceptor drum 10, they are rotatingly provided so that interference between the developing devices and chargers are minimized. FIG. 10 shows location relationship between developing devices 13. Provided that an angle formed by 01 –X in which 01 is the center of photoreceptor drum 10 and X which is a vertical line and line 01–02 in which point 01 is the center of photoreceptor drum 10 and point 02 (Y) is the center of developing roller 131 is defined to be θ1, an angle formed by vertical line 01–X and line 01–02 in which 01 is the center of the photoreceptor drum 10 and 02 (M) the center of developing device (M) is defined to be θ2, an angle formed by vertical line 01–X and line 01–02 (C) in which 01 is the center of the photoreceptor drum 10 and 02 the center of developing device (C) is defined to be 63 and an angle formed by vertical line 01–X and line 01–02 (K) in which 01 is the center of the photoreceptor drum 10 and 02 the center of developing device (K) is defined to be θ4, when θ4 is 80°–100°, developing device 13 (K) is located at almost horizontal right position from the photoreceptor drum. If θ4>θ1, developing device (Y) is provided at the left side of the photoreceptor drum. When θ3=30°–50°, the upper right portion from the photoreceptor drum, developing device 13(C) is provided. When θ3>θ2, developing device (M) i s provided at the left side of the photoreceptor drum.

In order to feed toner in hopper section 134 onto developing roller 131 or feeding roller 132 without being compressed, it is necessary for developing roller 131 and hopper section 134 to be within a prescribed relationship. Angle γ formed by line 01–02 in which point 01 is the center a photoreceptor drum 10 and point 02 is the center of developing roller 131 and line 02–H in which point 02 is the center of developing roller 131 and H is stirring center 134*b* of hopper section 134 is necessary to be 0° to 45° for favorable toner replenishment. If angle γ is larger than 45°, feeding of toner becomes considerably difficult. Toner is compressed tending to be coagulated. When developing, stripe occurs reducing developing performance.

Commonality of developing devices realizes easier in the internal image exposure type compared with the external image exposure type. In the internal image exposure type, the image exposure means are located inside of the image formation body. Developing devices including chargers are located in the vicinity of each other. Therefore, a common developing device can be utilized at only a small angle of rotation. In addition, the charger and the developing device can be integral without interference by an image exposure means.

As described above, in the case of the internal image exposure type, a small-sized photoreceptor drum is used. Developing devices and chargers are located on the circumference of the photoreceptor drum do not interfere. In addition, replenishment of toner is also favorable. With a small image forming apparatus, a favorable color image can be obtained.

EMBODIMENT 6

Figure 11:
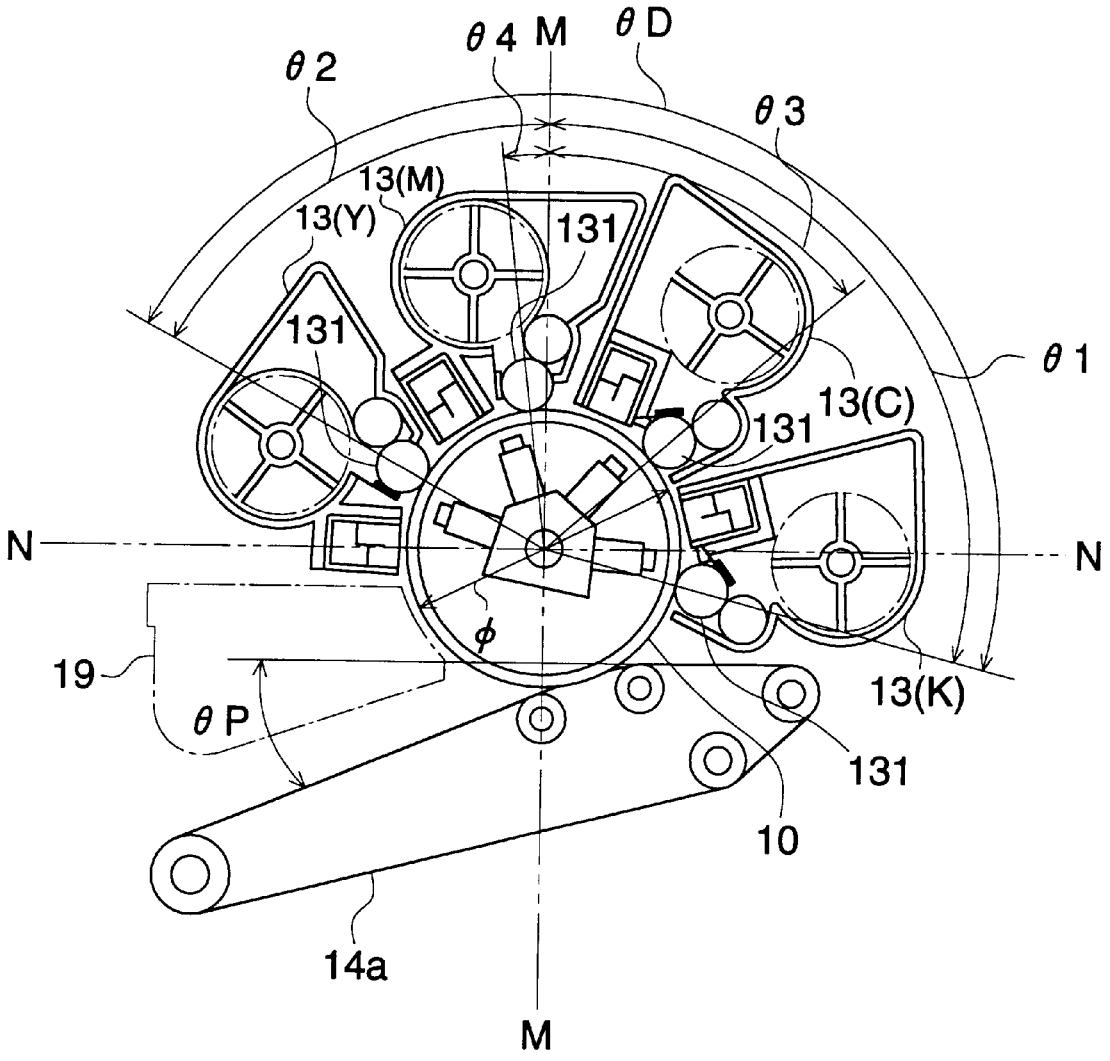
FIG. 11 is a schematic view showing the layout of the developing device of the sixth embodiment.

The present embodiment 6 will be explained referring to FIG. 11.

Angle θ1 formed by vertical line M—M which occupies the upper portion of from horizontal line N—N which passes the center of rotation of photoreceptor drum 10 and the center of developing sleeve 131 (K) of black (K) developing device 13 (K) is located with 85°–115° in clockwise direction.

In conjunction with the size of θ1, θD formed by a line connecting the center of photoreceptor drum 10 and the center of developing sleeve 131 in Y developing device (Y) and a line connecting the center of photoreceptor drum 10 and the center of developing sleeve 131 in K developing device (K) is provided 145° through 180° in the counterclockwise direction. When setting θD, it is set so that θ2 formed by vertical line M—M and a line connecting the center of photoreceptor drum 10 and the center of developing sleeve 131 in Y developing device 13 (Y) is smaller than connecting the center of photoreceptor drum 10 and the center of developing sleeve 131 in Y developing device 13 (Y) formed by vertical line M—M and a horizontal line N—N.

In addition, magenta (M) developing device 13 (M) and cyan (C) developing device 13 (C) are located equidistant along the periphery of photoreceptor drum 10 between developing device 13 (Y) and developing device (K). Angle θ3 formed by vertical line M—M and a line connecting the center of photoreceptor drum 10 and the center of developing sleeve 131 in developing device 13 (C) is arranged to be 35°–55°, which is larger than angle θ4, formed by vertical line M—M and a line connecting the center of photoreceptor drum 10 and the center of developing sleeve 131 in developing device 13 (M). θ4 is preferably 0° through 20°.

Due to the layout of each of the developing devices 13, the circumference surface of photoreceptor drum 10, specifically below developing device 13 (Y), is greatly reduced. As a result, it is possible to locate the cleaning device 19 below developing device 13 (Y) and, in addition, to locate the toner image receiving body 14*a* below the drum in a nearly horizontal manner. Recording paper P fed from the horizontal direction is conveyed at dip θP to the horizontal direction which may be referred to as a separation angle of 40° or less in which no problem occurs while conveyance after passing the transcription region, ensuring delivery effect to fixing device 17. The dip θP is most preferably 0° from the viewpoint of separation property. However, from the point that no influence occurs on the conveyance of recording paper P even if the diameter of photoreceptor drum 10 is small and from the point of arrangement of ambient chargers, developing devices and cleaner, specifically preferable angle θP is −10° to 30°.

It is preferable that the developing device is located as high as possible.

Central angle θD is preferably 180° or less. If central angle ηD is larger than 180°, the dimension of the cleaning device is restricted, and angle θP of the paper feeding path becomes close to 40° (or larger than 40°). Accordingly, separatability of a recording medium is reduced. As a result, problems occur in terms of layout. In addition, paper jamming occurs, causing a problem of the apparatus. It is more preferable that central angle θD is 175° or less.

In addition, if the central angle θD is smaller than 120°, influence on the paper feeding path of the recording medium P is smaller even though the cleaning device 19 located below developing device 13(Y) becomes a bit larger. However, in order to place chargers and developing devices, the outer diameter of the image forming body cannot help being larger. As a whole, an apparatus entirely becomes larger. Accordingly, it is preferable that central angle θD is 120° or more. More preferably, the angle is 145° or more. Specifically more preferably, the central angle is 150° or more.

EMBODIMENT 7

Figure 12:
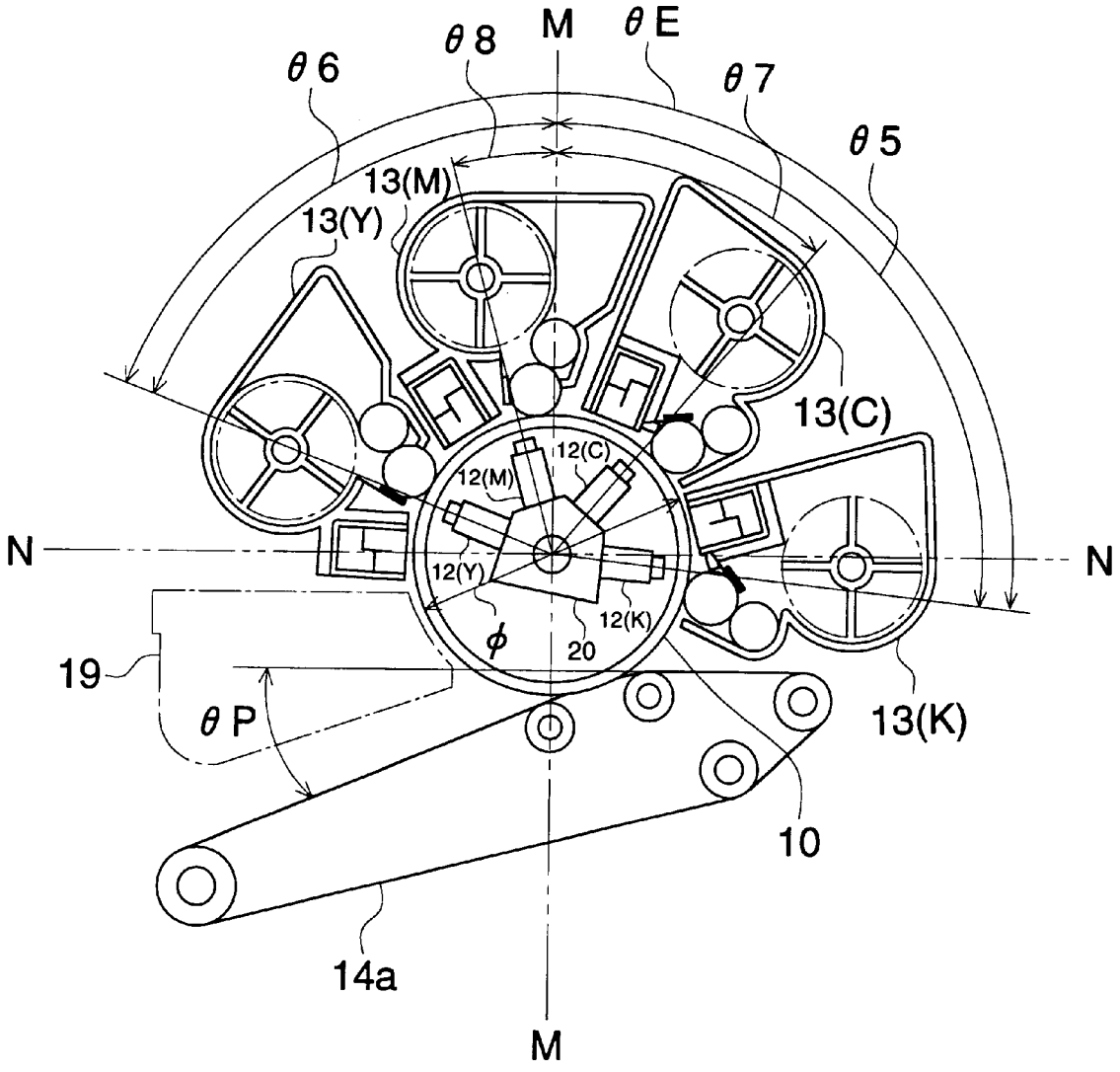
FIG. 12 is a schematic view showing the layout of the exposure unit of the seventh embodiment.

Present embodiment 7 will be explained referring to FIG. 12.

Central angle θ5 formed by vertical line M—M which occupies the upper portion of from horizontal line N—N which passes the center of the rotation of photoreceptor drum 10 and the exposure unit 12 (K) is located with 75°–105° in clockwise direction.

When forming exposure unit 12 (Y) facing a yellow developing device 13 (Y), it is provided inside the photoreceptor drum in which a central angle θE constitutes 145°–180°. When forming the central angle θE, the central angle θ6 is smaller than the central angle θ5.

In addition, magenta (M) developing device 13 (M) and cyan (C) developing device 13 (C) are located equidistant along the periphery of photoreceptor drum 10 between developing device 13 (Y) and developing device 13 (K). Angle θ7 formed by vertical line M—M and a line connecting the center of photoreceptor drum 10 and the exposure unit 12 (C) is arranged to be 25°–45°, which is larger than angle θ8, formed by vertical line M—M and a line connecting the center of photoreceptor drum 10 and exposure unit 12 (M). θ8 is preferably 10° through 30°.

Since each of the exposure units is mounted inside the circumference of photoreceptor drum 10 within respective allowable central angle range, the position of each developing device 13 which occupies its designated external circumferential space of photoreceptor drum 10 can be regulated by controlling positional relationship of respective developing devices 13.

As a result, it is possible to locate the cleaning device 19 below developing device 13 (Y) and, in addition, to locate the toner image receiving body 14*a* below the drum in a nearly horizontal manner. Recording paper P fed from the horizontal direction is conveyed at dip θP to the horizontal direction which may be referred to as a separation angle of 40° or less in which no problem occurs while conveyance after passing the transcription region, ensuring delivery effect to fixing device 17. The dip θP is most preferably 0° from the viewpoint of separation property. However, from the point that no influence occurs on the conveyance of recording paper P even if the diameter of photoreceptor drum 10 is small and from the point of arrangement of ambient chargers, developing devices and cleaner, specifically preferable angle θP is −10° to 30°.

Developing device 13 (Y) is preferable to be located as high as possible. When the central angle θD is arranged to be close to 145°, i.e., smaller angle side, influence on paper feeding system of recording paper P remains small, even if cleaning device 19, positioning below developing device 13 (Y), is more or less larger. In addition, in order to place chargers and developing devices additionally, the outer diameter of the image forming body have to be increased. On the contrary, if the central angle θD is arranged to be close to 180°, i.e., larger angle side, the dimension of the cleaning device is greatly restricted. The dip angle θP becomes close to 40°. If the dip angle θP is larger than 180°, to set dip angle θP at 40° or less becomes difficult. Separation property of the recording paper is reduced, causing interference in terms of layout. For safety, the central angle θD is 145°–180°, and more preferably 150°–175°.

EMBODIMENT 8

A constitution, in which the replacement of the developing device using a one-component developer having high replacement frequency and jamming processing of recording paper is easy, will be explained.

Figure 13:
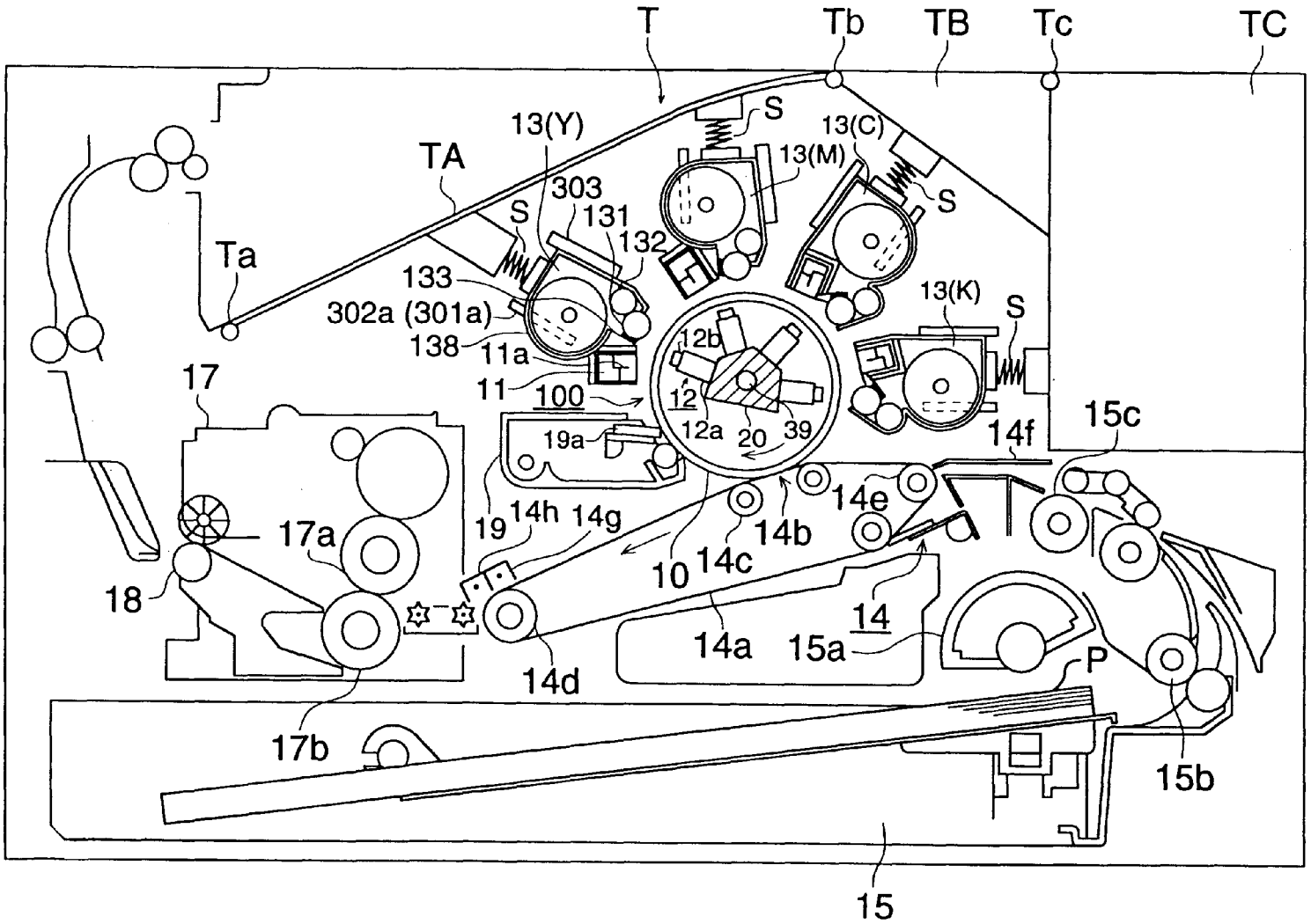
FIG. 13 shows a cross sectional view of a color image forming apparatus of the eighth embodiment.

As shown in FIG. 13, a color image forming apparatus of the present invention is provided with an open/close cover T. The open/close cover T includes a cover section TA provided rotatably by means of hinge Ta, Tb and Tc and bodies TB and TC.

Figure 14:
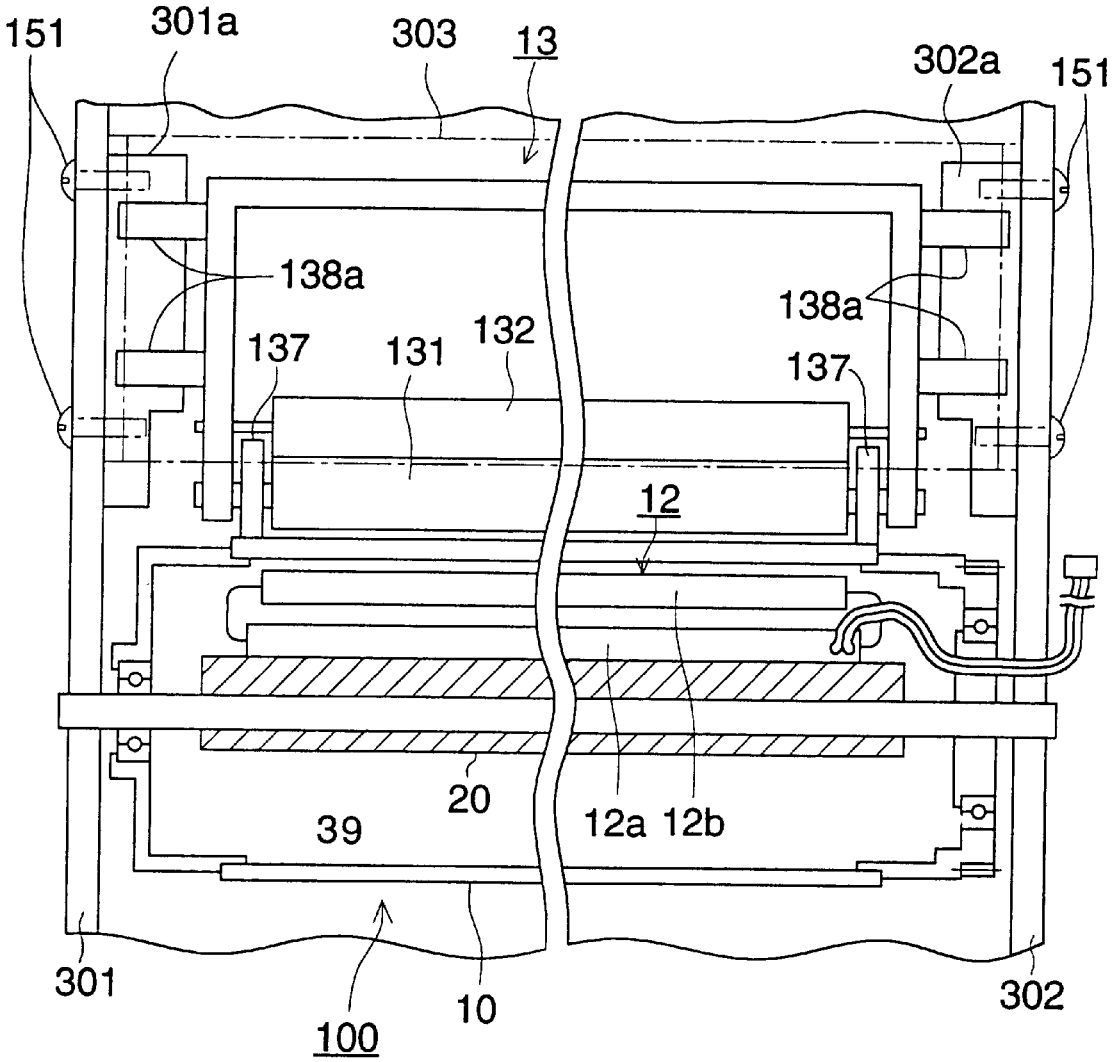
FIG. 14 is a cross sectional view showing the mounting state of a developing means onto an image forming body.

As shown in FIG. 14, on both side plates 301 and 302 in the apparatus main body, guide rail 301*a* and 302*a* for detaching developing device 13 for each color was provided. In addition, guide plate 303 is mounted by screw 151 while extending it on both side plates 301 and 302. Guide rails 301*a* and 302*a* which corresponds to developing devices for each color parallelly face guide plate 303 as a plate member and are fixed onto both side plates 301 and 302.

With guide plate 303 and guide rail 301*a* and 302*a* as guide means, developing device 13 is inserted while being sandwiched by guide plate 303 and guide rails 301*a* and 302*a*. Inside guide rails 301*a* and 302*a* facing each other and at both ends of developing casing 138 of developing device 13, two guide pins 138*a* are respectively engaged. In addition, the side portion of developing casing 138 is brought into contact with the inside of guide plate 303. Developing devices 13 are parallel inserted to guide rails 301*a* and 302*a* with guide plate 303 and guide rails 301*a* and 302*a*.

Due to pressure spring S, formed by an elastic member and mounted on an open/close cover T mounted above the, apparatus main body, developing devices 13 for each color 13 are pressed on their rear surface so that pushing roller 137 provided on both ends of developing devices 13 are brought into contact with photoreceptor drum 10.

As described above, due to fixing plural pieces of guide plates between both side plates of the process units, the guide plate functions in place of a reinforcement member using a stay which is conventionally used. Accordingly, the process unit body in which it is difficult to provide a reinforcement member is reinforced and considerable great space is provided necessary for detaching plural developing means as well.

Figure 15:
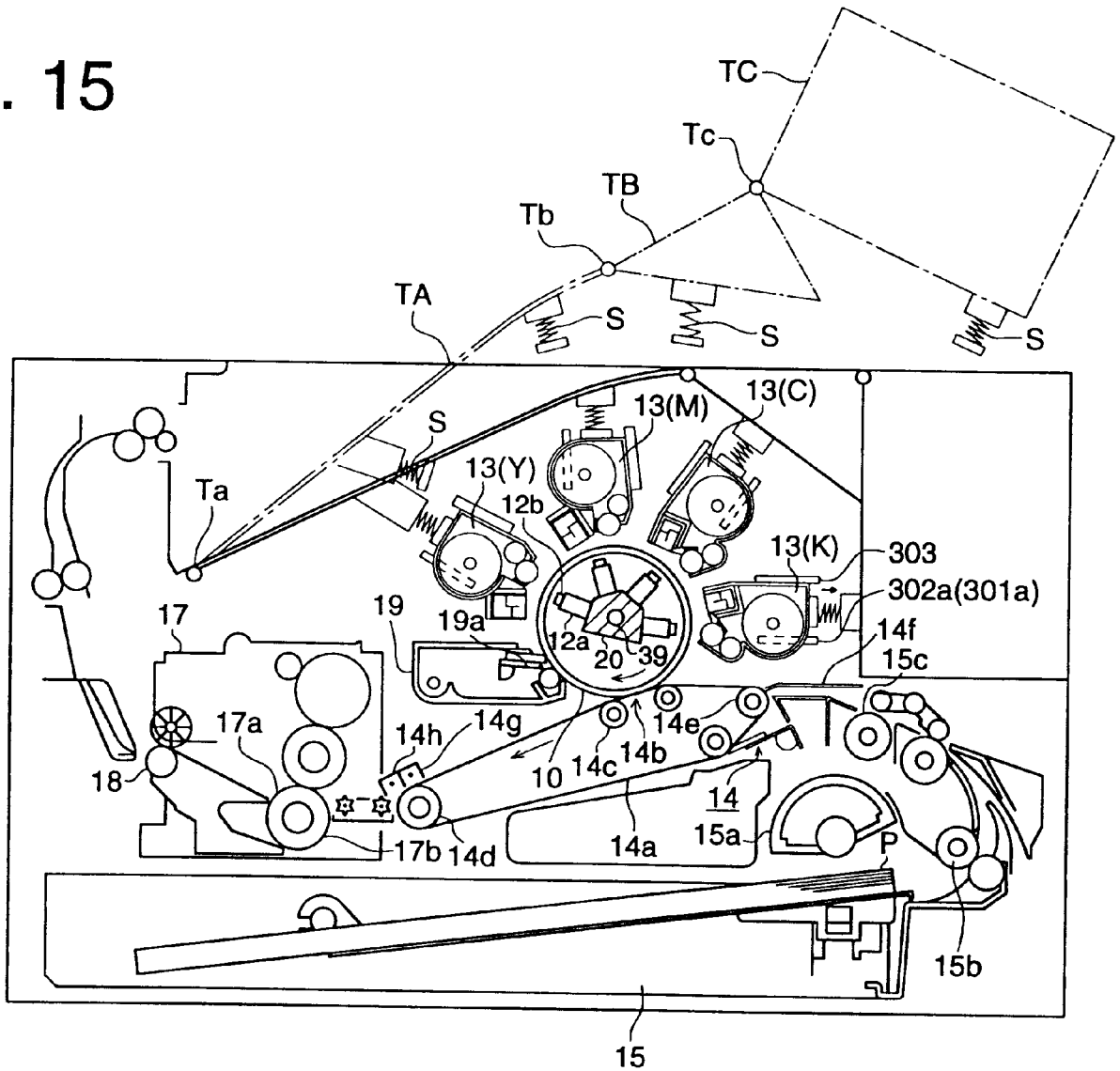
FIG. 15 is a drawing showing a replacement of the developing means.

According to FIG. 15, as shown by dashed lines in FIG. 15, when developing devices 13 are subjected to maintenance and replacement, an open/close cover T in the color image forming apparatus is opened with hinge Ta as the central shaft. First, body TC is opened with hinge Tc as the central shaft. Next, body TB is opened with hinge Tb as the central shaft. Pressure springs provided on bodies TB and TC are separated from K and C developing devices 13 so that pressure by K and C developing devices 13 is released. Finally, cover section TA is opened with hinge Ta as the central shaft. Pressure spring S provided on cover section TA is separated from M and K developing devices 13 so that pressure on M and K developing devices is released.

With guide plate 303 and guide rails 301*a* and 302*a* as guide means, developing device 13 (K) is withdrawn parallelly with guide plate 303, guide rails 301*a* and 302*a*, and then subjected to maintenance and replacement. Other developing devices 13 are also withdrawn parallelly with guide plate 303, guide rails 301*a* and 302*a*, and then subjected to maintenance and replacement.

In order for developing device 13 (K) having high using frequency and having high maintenance and replacement frequency to be maintained and replaced easily, the developing device 13 (K) is mounted facing body TC which forms the first aperture. Body TC can independently be opened so that replacement of developing device 13 (K) is facilitated.

Due to the above, replacement of a developing means which houses one-component developer having high replacement frequency becomes easy. Together with this, the developing means is removed so that jamming processing of a recording medium which occurs on the circumference of image forming body is facilitated. In addition, the developing means is simplified so that it may be surely pressed on the image forming body.

Figure 16:
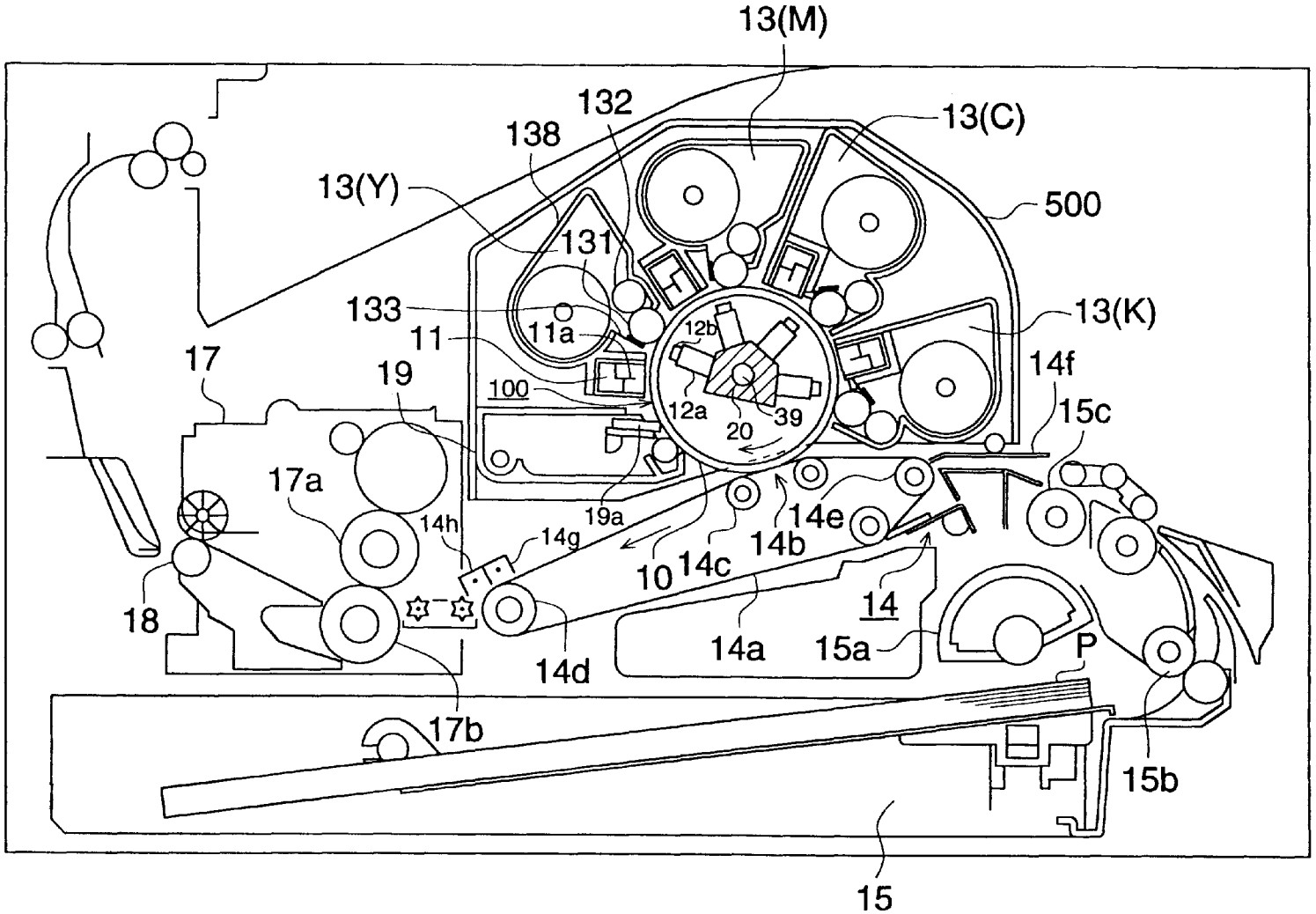
FIG. 16 is a drawing showing a color image forming apparatus having a processing cartridge.
Figure 17:
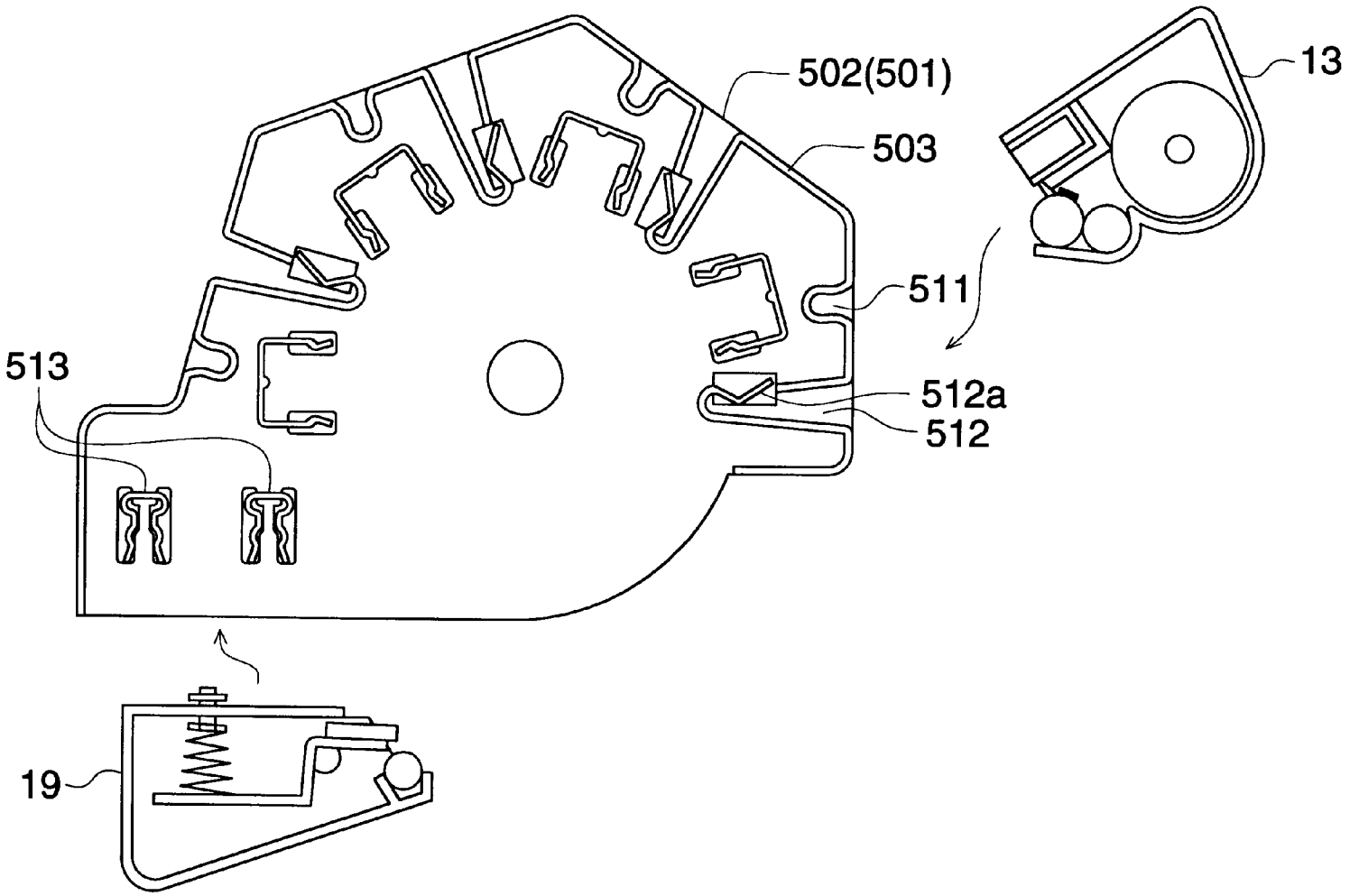
FIG. 17 is a drawing showing a detachment method of a developing means onto a processing cartridge.

A process cartridge is explained referring to FIGS. 16 or 17. FIG. 16 shows a process cartridge in a color image forming apparatus. FIG. 17 is a drawing showing a detachment method of the developing means to the process cartridge.

Process cartridge 500 is integrally constituted of image forming body unit 100 in which photoreceptor drum 10 and exposure optical system 12 are integral, scorotron chargers 11 for each color, developing devices 13 for each color and cleaning device 19. In addition, image forming process by the use of each process member including toner image receiving body 14*a* and fixing device 17 are provided similarly. Developing device 13 for each color integrally maintaining scorotron charger 11 described later is loaded at the prescribed position of both side plates 301 and 302.

While image carrier unit 100 is positioned accurately with respect to the position of exposure optical system 12, it is fixed to side plates (not illustrated) of both sides of process cartridges 500 shown in FIG. 17. Developing devices 13 for each color integrally maintaining scorotron charger 11 described later are loaded at prescribed positions on both side plates 501 and 502. Incidentally, side plate 502 is an inner side plate in FIG. 7.

As shown in FIG. 17, on the respective side wall of side plate 501 (not illustrated) and 502 of both sides of process cartridge 500, band-shaped side band 503 is provided. Guide notches 511 and 512 as a guide means for housing developing devices for each color is constituted. At the end portion of guide notch 512, platespring 512*a* is provided. Guide notches 511 and 512 provided on side plates 501 (not illustrated) and 502 in front of process cartridge 500 is symmetrically provided from the inner side plate 502.

Onto guide notches 511 and 512, in the same manner as explained in FIG. 14, two guide pins (not illustrated) respectively provided on the external wall of both sides of developing casing 138 are inserted and then developing devices are loaded. In the same manner, on holders by plate spring 513 provided on two side wall points of both side plates 501 and 502 of process cartridge 500, two pins are inserted so that cleaning device 19 is engaged with side plates 501 and 502 (not illustrated) to be mounted. Thus, process cartridge 500 is constituted.

In FIG. 16, process cartridge 500 can be loaded from the front side horizontally or from above the main body vertically. Process cartridge 500 is withdrawn from the main body so that developing devices are subjected to maintenance and replacement.

Due to the above, jamming processing of a recording medium which is easy to occur between an image forming body and the toner image receiving body. In addition, replacement of developing means housing one-component developer having high exchange frequency becomes easy.

Figure 18:
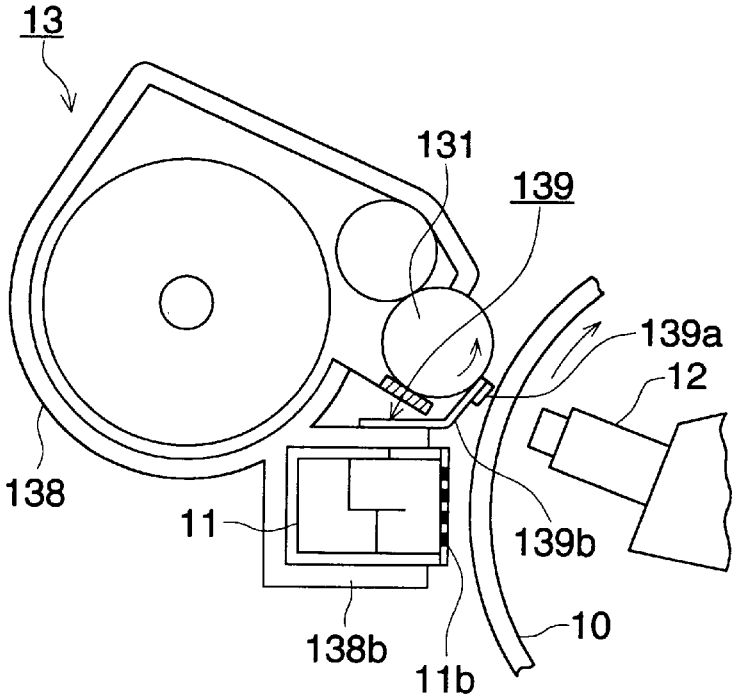
FIG. 18 is a drawing showing a charging means integrally provided to a developing means.

FIG. 18 is a drawing showing a charging means integrally provided on developing means. As shown in FIG. 18, on the upstream side of rotation of photoreceptor drum 10 of developing casing 138 of developing devices 13, parallel to developing sleeve 131, concave section 138*b* in which the cross section is concave is provided, scorotron charger is engaged. Scorotron charger 11 is located closely parallel to developing device 13. Scorotron chargers 11 and developing devices 13 are integrally detachable with the color image forming apparatus main body explained in FIG. 13 or process cartridge 500 explained in FIG. 16. In addition, between scorotron chargers 11 and developing devices 13 closely located each other, image exposure is conducted by means of exposure optical system 12 from inside of photoreceptor drum 10. The position of image exposure by means of exposure optical system 12 is upstream in the direction of rotation of photoreceptor drum 10 of developing device 13. A control grid 11*b* is provided in scorotron charger 11 and controls the charged potential.

Due to providing the image exposure means inside of the image forming body, the charging means and the developing means can closely be located. Therefore, downsizing of the charging section and the developing section is enabled.

Further, at the developing position in developing device 13 and upstream in the direction of rotation of photoreceptor drum 10, development control electrode 139 is provided. Development control electrode 139 is mounted parallel to developing sleeve 131 on the side wall on the side in which scorotron charger 11 is provided on the upstream side of rotation of photoreceptor drum 10. The development control electrode 139 is brought into contact with the developer layer on developing sleeve 131 at the developing region or on the upstream of rotation (counterclockwise) of developing sleeve shown by an arrow in FIG. 18. In this occasion, exposure optical system 12 is provided facing development control electrode 139.

As described above, development control electrode 139 is located parallel to the longitudinal direction of developing sleeve 131. It is a plate-shaped member mounted on developing casing 138. It is constituted by insulating electrode plate 139*b* and band-shaped electrode 139*a* which is brought into contact with a developer layer with electrode plate 139*b*. When developing, while A.C. bias in which D.C. component is superposed is impressed on developing sleeve 131, strong vibrational electrical field is formed between developing sleeve 131 and development control electrode 139 by impressing approximately the same D.C. voltage on electrode 139*a*. As a result, a toner cloud is caused. Thus, developability having high image quality is obtained.

Downsizing of the charging section and the developing section is contrived as described above. In addition, a development control electrode can be provided as described above.

Figure 19:
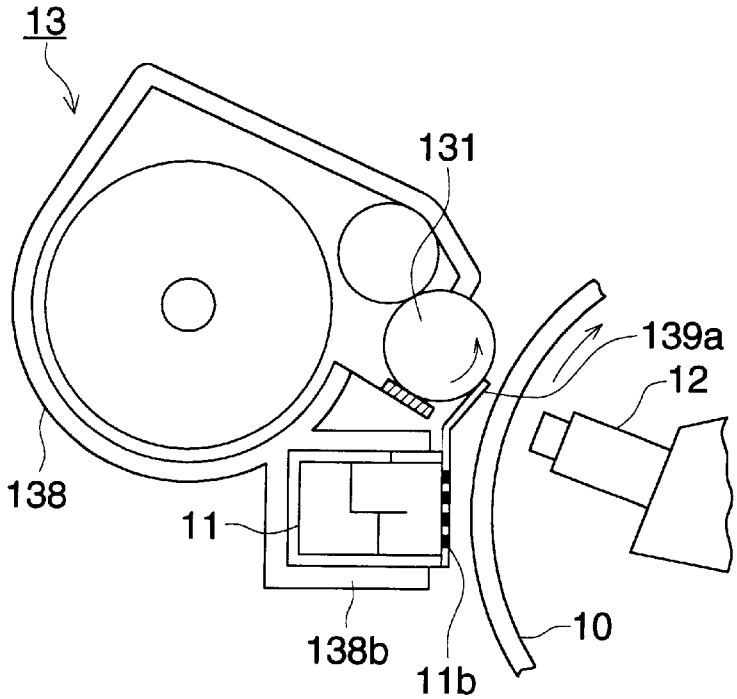
FIG. 19 is a drawing showing another example of a developing controlling electrode.

Onto the control grid 11*b* and electrode 139*a* of development control electrode 139, a voltage higher than individual power supply is impressed, and thereby control of charge potential of photoreceptor drum 10 and development potential is conducted. However, due to that the control grid is impressed with the same potential as photoreceptor potential and that electrode 139*a* of development control electrode 139 in reversal development is set to ±300 V at the same polarity as the photoreceptor potential. FIG. 19 is a drawing showing another example of a development control electrode. As shown in FIG. 19, control grid 11*b* is integral with electrode 139*a* of development control electrode 139 explained in FIG. 18, and they can be used in combination. Voltage is impressed from the same power supply, and the same potential may be used. In this occasion, it is preferable to coat insulatingly a portion which is brought into contact with developing sleeve 131 of electrode 139*a*.

Control grid 11*b* and electrode 139*a* (see development control electrode 139 in FIG. 18) are caused to be integral. To them, voltage is impressed. By arranging to be the same potential, discharge between each high voltage member can be prevented. In addition, by commonality the power supply, power supply is limited to be one. Therefore, reduction of cost can be contrived.

According to the inventions described in Embodiments 1 through 4, feeding and charging of one-component developer is favorably conducted. As a result, a favorable developing layer is formed on a developing roller. Therefore, a favorable image having no image unevenness and incomplete image formation can be obtained.

According to the invention described in Embodiment 5, commonality of developing devices is contrived. As a result, a small and favorable color image forming apparatus capable of processing at high speed can be provided.

According to the invention described in Embodiment 6, in the case of a small-size photoreceptor drum whose outer diameter is 100 mm or less, plural charging means, plural image exposure means and plural developing means and cleaning means can be placed with well-balance. In addition, recording paper feeding system can be made close to horizontal. As a result, compact placement and constitution becomes possible.

According to the invention described in Embodiment 7, realization of the above-mentioned layout is enhanced. In addition, separatability of recording medium from the photoreceptor drum is highly maintained. In addition, conveyance property is also favorably increased. Thus, handing over to the fixing device becomes sure.

According to an invention described in Embodiment 8, replacement of developing means housing one-component developer having high replacement frequency is facilitated. In addition, jamming processing of recording medium which occurs on the circumference of the image forming body is facilitated.

The developing means is simplified so that a recording medium can be pressed on the image forming body surely.

By providing the image exposure means inside the image forming body, the charging means and the developing means can be arranged closely so that downsizing of the charging section and the developing section is contrived.

In addition to downsizing charging and developing sections, the development control electrode can be provided.

By the use of control grid and the development control electrode in combination, the same power supply can be used. Accordingly, cost reduction can be contrived. In addition, discharging which can impress a high voltage is prevented.

What is claimed is:

1. A color image forming apparatus comprising:

a photoreceptor drum having an outer diameter of 50 mm to 100 mm and a rotational axis;

four charging devices for charging the photoreceptor drum;

four exposure devices, provided inside the photoreceptor drum, for imagewise exposing an outer surface of the photoreceptor drum to form respective four latent images through an inner surface of the photoreceptor drum;

four developing devices, provided outside the photoreceptor drum at an upper section of the photoreceptor drum, for developing respective ones of the four latent images using respective different one-component type color developers to form four different color toner images in a superimposed manner on the outer surface of the photoreceptor drum during one rotation of the photoreceptor drum, wherein each developing device has a developing roller for conveying the respective one-component type developers to the outer surface of the photoreceptor drum, wherein the four developing devices are arranged along an outer circumference of the photoreceptor drum in a manner such that a rotational axis of each of the developing rollers of the four developing devices is located within a central angle of 180°, and wherein a developer layer is formed on each of the developing rollers and each of the four developing devices has a regulating member for regulating a thickness of the developer layer formed on the developing roller thereof; and a transfer device, provided at a lower section of the photoreceptor drum, for transferring the superimposed four different color toner images from the outer surface of the photoreceptor drum to a sheet, wherein the transfer device comprises an inlet sheet passage and an outlet sheet passage, and wherein the outlet sheet passage is arranged to be one of: (i) coplanar with the inlet sheet passage, and (ii) inclined with respect to the inlet sheet passage at an angle between 10° above the inlet sheet passage and 30° beneath the inlet sheet passage;

wherein the regulating member of each of the four developing devices has a fixed end and a free end and is arranged in one of: (i) a trail form wherein the free end is brought in contact with the developing roller at a position located downstream of the fixed end with respect to a rotational direction of the developing roller, and (ii) a counter form wherein the free end is brought in contact with the developing roller at a position located upstream of the fixed end with respect to the rotational direction of the developing roller thereof;

wherein in the trail form, the regulating member is arranged in a manner such that a line connecting a contact point between the free end of the regulating member and the developing roller with the rotational axis of the developing roller crosses at an angle $\alpha 1$ of 90±20° with a line connecting the rotational axis of the developing roller with the rotational axis of the photoreceptor drum.

2. The color image forming apparatus of claim 1, wherein each developing device comprises a feeding roller to feed the one-component type color developer stored therein to the developing roller thereof, and wherein the feeding roller is arranged in a manner such that a line connecting a rotational axis of the feeding roller with the rotational axis of the developing roller crosses at an angle $\beta 1$ of 20°±20° with the line connecting the rotational axis of the developing roller with the rotational axis of the photoreceptor drum.

3. The color image forming apparatus of claim 1, wherein in the counter form, the regulating member is arranged in a manner such that a line connecting the contact point between the free end of the regulating member and the developing roller with the rotational axis of the developing roller crosses at an angle $\alpha 2$ of 0°±20° with the line connecting the rotational axis of the developing roller with the rotational axis of the photoreceptor drum.

4. The color image forming apparatus of claim 3, wherein each developing device comprises a feeding roller to feed the one-component type color developer stored therein to the developing roller thereof, and wherein the feeding roller is arranged in a manner such that a line connecting a rotational axis of the feeding roller with the rotational axis of the developing roller crosses at an angle $\beta 2$ of 40°±20° with the line connecting the rotational axis of the developing roller with the rotational axis of the photoreceptor drum.

5. A color image forming apparatus comprising:

a photoreceptor drum having an outer diameter of 50 mm to 100 mm and a rotational axis;

four charging devices for charging the photoreceptor drum;

four exposure devices, provided inside the photoreceptor drum, for imagewise exposing an outer surface of the photoreceptor drum to form respective four latent images through an inner surface of the photoreceptor drum;

four developing devices, provided outside the photoreceptor drum at an upper section of the photoreceptor drum, for developing respective ones of the four latent images using respective different one-component type color developers to form four different color toner images in a superimposed manner on the outer surface of the photoreceptor drum during one rotation of the photoreceptor drum, wherein each developing device has a developing roller for conveying the respective one-component type developers to the outer surface of the photoreceptor drum, wherein the four developing devices are arranged along an outer circumference of the photoreceptor drum in a manner such that a rotational axis of each of the developing rollers of the four developing devices is located within a central angle of 180°, wherein each of the four developing devices has an agitating member for agitating the respective one-component type color developers, and wherein the agitating members are arranged in a manner such that a line connecting a rotational axis of each of the agitating members with the rotational axis of the developing roller corresponding thereto crosses at an angle of 0° to 45° with a line connecting the rotational axis of the corresponding developing roller with the rotational axis of the photoreceptor drum; and a transfer device, provided at a lower section of the photoreceptor drum, for transferring the superimposed four different color toner images from the outer surface of the photoreceptor drum to a sheet, wherein the transfer device comprises an inlet sheet passage and an outlet sheet passage, and wherein the outlet sheet passage is arranged to be one of: (i) coplanar with the inlet sheet passage, and (ii) inclined with respect to the inlet sheet passage at an angle between 10° above the inlet sheet passage and 30° beneath the inlet sheet passage.

6. A color image forming apparatus comprising:

a photoreceptor drum having an outer diameter of 50 mm to 100 mm and a rotational axis;

four charging devices for charging the photoreceptor drum;

four exposure devices, provided inside the photoreceptor drum, for imagewise dosing an outer surface of the photoreceptor drum to form respective four latent images through an inner surface of the photoreceptor drum;

four developing devices, provided outside the photoreceptor drum at an upper section of the photoreceptor drum, for developing respective ones of the four latent images using respective different one component type color developers to form four different color toner images in a superimposed manner on the outer surface of the photoreceptor drum during one rotation of the photoreceptor drum, wherein each developing device has a developing roller for conveying the respective one component type developers to the outer surface of the photoreceptor drum, wherein the four developing devices are arranged along an outer circumference of the photoreceptor drum in a manner such that a rotational axis of each of the developing rollers of the four developing devices is located within a central angle of 180°, and wherein a developer layer is formed on each of the developing rollers and each of the four developing devices has a regulating member for regulating a thickness of the developer layer formed on the developing roller thereof; and a transfer device, provided at a lower section of the photoreceptor drum, for transferring the superimposed four different color toner images from the outer surface of the photoreceptor drum to a sheet;

wherein the regulating member of each of the four developing devices has a fixed end and a free end and is arranged in one of: (i) a trail form wherein the free end is brought in contact with the developing roller at a position located downstream of the fixed end with respect to a rotational direction of the developing roller, and (ii) a counter form wherein the free end is brought in contact with the developing roller at a position located upstream of the fixed end with respect to the rotational direction of the developing roller thereof;

wherein in the trail form, the regulating member is arranged in a manner such that a line connecting a contact point between the free end of the regulating member and the developing roller with the rotational axis of the developing roller crosses at an angle $\alpha 1$ of 90°±20° with a line connecting the rotational axis of the developing roller with the rotational axis of the photoreceptor drum.

7. The color image forming apparatus of claim 6, wherein each developing device comprises a feeding roller to feed the one-component type color developer stored therein to the developing roller thereof, and wherein the feeding roller is arranged in a manner such that a line connecting a rotational axis of the feeding roller with the rotational axis of the developing roller crosses at an angle $\beta 1$ of 20°±20° with the line connecting the rotational axis of the developing roller with the rotational axis of the photoreceptor drum.

8. The color image forming apparatus of claim 6, wherein in the counter form, the regulating member is arranged in a manner such that a line connecting the contact point between the free end of the regulating member and the developing roller with the rotational axis of the developing roller crosses at an angle $\alpha 2$ of 0°±20° with the line connecting the rotational axis of the developing roller with the rotational axis of the photoreceptor drum.

9. The color image forming apparatus of claim 8, wherein each developing device comprises a feeding roller to feed the one-component type color developer stored therein to the developing roller thereof, and wherein the feeding roller is arranged in a manner such that a line connecting a rotational axis of the feeding roller with the rotational axis of the developing roller crosses at an angle $\beta 2$ of 40°±20° with the line connecting the rotational axis of the developing roller with the rotational axis of the photoreceptor drum.

10. A color image forming apparatus comprising:

a photoreceptor drum having a rotational axis;

four charging devices for charging the photoreceptor drum;

four exposure devices, provided inside the photoreceptor drum, for imagewise exposing an outer surface of the photoreceptor drum to form respective four latent images through an inner surface of the photoreceptor drum;

four developing devices, provided outside the photoreceptor drum at an upper section of the photoreceptor drum, for developing respective ones of the four latent images using respective different one-component type color developers to form four different color toner images in a superimposed manner on the outer surface of the photoreceptor drum during one rotation of the photoreceptor drum, wherein each developing device has a developing roller for conveying the respective one-component type developers to the outer surface of the photoreceptor drum, wherein the four developing devices are arranged along an outer circumference of the photoreceptor drum in a manner such that a rotational axis of each of the developing rollers of the four developing devices is located within a central angle of 180°, and wherein a developer layer is formed on each of the developing rollers and each of the four developing devices has a regulating member for regulating a thickness of the developer layer formed on the developing roller thereof; and a transfer device, provided at a lower section of the photoreceptor drum, for transferring the superimposed four different color toner images from the outer surface of the photoreceptor drum to a sheet;

wherein the regulating member of each of the four developing devices has a fixed end and a free end and is arranged in one of: (i) a trail form wherein the free end is brought in contact with the developing roller at a position located downstream of the fixed end with respect to a rotational direction of the developing roller, and (ii) a counter form wherein the free end is brought in contact with the developing roller at a position located upstream of the fixed end with respect to the rotational direction of the developing roller thereof;

wherein in the trail form, the regulating member is arranged in a manner such that a line connecting a contact point between the free end of the regulating member and the developing roller with the rotational axis of the developing roller crosses at an angle $\alpha 1$, of 90°±20° with a line connecting the rotational axis of the developing roller with the rotational axis of the photoreceptor drum.

11. The color image forming apparatus of claim 10, wherein each developing device comprises a feeding roller to feed the one-component type color developer stored therein to the developing roller thereof, and wherein the feeding roller is arranged in a manner such that a line connecting a rotational axis of the feeding roller with the rotational axis of the developing roller crosses at an angle $\beta 1$ of 20°±20° with the line connecting the rotational axis of the developing roller with the rotational axis of the photoreceptor drum.

12. The color image forming apparatus of claim 10, wherein in the counter form, the regulating member is arranged in a manner such that a line connecting the contact point between the free end of the regulating member and the developing roller with the rotational axis of the developing roller crosses at an angle $\alpha 2$ of 0°±20° with the line connecting the rotational axis of the developing roller with the rotational axis of the photoreceptor drum.

13. The color image forming apparatus of claim 12, wherein each developing device comprises a feeding roller to feed the one-component type color developer stored therein to the developing roller thereof, and wherein the feeding roller is arranged in a manner such that a line connecting a rotational axis of the feeding roller with the rotational axis of the developing roller crosses at an angle $\beta 2$ of 40°±20° with the line connecting the rotational axis of the developing roller with the rotational axis of the photoreceptor drum.

* * * * *